US005529432A

United States Patent [19]

Huynh et al.

[11] Patent Number: 5,529,432

[45] Date of Patent: Jun. 25, 1996

[54] APPARATUS AND METHOD FOR MARKING A SURFACE

[75] Inventors: Duc Huynh, Fremont; Daniel D. Sieben, Menlo Park; Donald W. Nusbaum, Woodside, all of Calif.

[73] Assignee: Pavement Marking Technologies, Inc., Menlo Park, Calif.

[21] Appl. No.: 540,000

[22] Filed: Oct. 6, 1995

Related U.S. Application Data

[62] Division of Ser. No. 167,662, Dec. 14, 1993, Pat. No. 5,486,067.

[51] Int. Cl.[6] ..... E01C 23/16; E01F 9/04

[52] U.S. Cl. ..... 404/84.05; 404/94; 118/668; 118/698; 239/227

[58] Field of Search ..... 404/84.05, 93, 404/94, 72, 75; 118/305, 323, 668, 669, 696, 697, 708, 712; 239/227; 156/356

[56] References Cited

U.S. PATENT DOCUMENTS

| | | | |
|---|---|---|---|
| 4,564,410 | 1/1986 | Clitheros et al. | 118/323 X |
| 4,584,964 | 4/1986 | Engel | 118/697 |
| 4,856,931 | 8/1989 | Bollag | 404/93 X |
| 4,865,257 | 9/1989 | Bailey | 239/288.5 |
| 4,880,663 | 11/1989 | Shimada | 427/96 |
| 4,979,380 | 12/1990 | Robbins et al. | 68/205 R |
| 5,294,798 | 3/1994 | Hartman | 404/94 X |
| 5,316,219 | 5/1994 | Christyson et al. | 239/597 X |
| 5,348,585 | 9/1994 | Weston | 118/305 |

FOREIGN PATENT DOCUMENTS

| | | | |
|---|---|---|---|
| 2650006 | 1/1991 | France | 404/94 |

*Primary Examiner*—Michael Powell Buiz
*Assistant Examiner*—James A. Lisehuru
*Attorney, Agent, or Firm*—Flehr, Hobach, Test, Albritton & Herbert

[57] ABSTRACT

A method and apparatus for marking a surface with a predetermined pattern is described. The apparatus includes a surface marking mechanism that supports a material dispenser. The material dispenser is manipulated along a number of axes including an x-axis, a y-axis, and a z-axis. In addition, the material dispenser is manipulated to rotate around a w-axis and to form a tilt angle with the w-axis. The surface marking mechanism includes movement devices for initial positioning of the mechanism and for re-positioning the mechanism to complete a selected pattern that does not fit within the border of the mechanism. The surface marking mechanism is responsive to control signals from a controller. The control signals are derived from a mathematical model characterizing the spatial relationship between the predetermined pattern, the material dispenser, and the surface to be marked.

20 Claims, 19 Drawing Sheets

APPARATUS AND METHOD FOR MARKING A SURFACE

This is a division, of application Ser. No. 08/167,662 filed Dec. 14, 1993, now U.S. Pat. No. 5,486,067.

BRIEF DESCRIPTION OF THE INVENTION

This invention relates generally to marking a surface to form an informational pattern. This invention more particularly relates to a transportable apparatus, including computer driven surface marking devices, that automatically applies a selected informational pattern to a surface.

BACKGROUND OF THE INVENTION

Surfaces, such as pavement, commonly include an informational pattern to convey information to drivers and pedestrians. Informational patterns may be in the form of symbols, such as arrows, or the informational patterns may be words, such as "stop", "yield" and "RR Crossing". Surfaces may also bear informational patterns in the form of company logos and the like.

The most common approach to marking a pavement surface is to use stencils. Such stencils may be made of one or multiple pieces, and they may be reusable or made of material for one-time use only, for example masking tape. Typically, a stencil is placed on a pavement surface and a spray gun, brush, or other painting instrument is used to apply paint to the pattern-defining apertures in the stencil. To improve nighttime visibility on pavement, glass beads or other reflective material may be sprinkled on top of the paint.

There are a number of problems associated with the use of stencils to mark pavement or other traffic carrying surface. First, the selected surface must be blocked-off to protect workers from moving traffic. Even after a surface is blocked-off, workers often are required to hazardously labor adjacent to moving traffic.

Second, because of the large scale of traffic marking stencils, they are relatively cumbersome. A typical work truck is therefore limited to carrying only a small number of pavement symbol stencils. Thus, frequent trips to a base station are required to exchange stencils.

Stencils have to be carefully positioned and the paint applied to the stencil must be uniformly distributed in a selected thickness. For instance, low output and/or too rapid application of paint may result in a thinly applied paint layer. This results in premature wear of the applied pattern and additional inspection and reapplication costs.

Another problem with the use of stencils is that the paint that is used must be specifically formulated for slow drying to insure that there is sufficient time to apply glass beads. Since the paint is slow drying, it is usually necessary to leave the selected surface marked-off for a period of time after the work is completed. Consequently, the marked-off surface disrupts traffic for an extended period of time. In addition, the work crew is required to return to the site after the drying process is completed to remove protective barriers.

Still another problem with the use of stencils is that they require periodic cleaning to prevent paint build-up. This cleaning requirement adds to the cost associated with the use of stencils.

SUMMARY OF THE INVENTION

A method and apparatus for marking a surface with a predetermined pattern without the use of stencils or other superpositioned pattern masks is described. The apparatus comprises a surface marking mechanism that supports a material dispenser. The material dispenser is manipulated along a number of axes including an x-axis, a y-axis, and a z-axis. In addition, the material dispenser is manipulated to rotate around a w-axis and to form a tilt angle with the w-axis. The surface marking mechanism includes movement devices for initial positioning of the mechanism and for re-positioning the mechanism to complete a selected pattern that does not fit within the border of the mechanism as originally positioned. The surface marking mechanism is responsive to control signals from a controller. The control signals are derived from a mathematical model characterizing the spatial relationship between the predetermined pattern, the material dispenser, and the surface to be marked.

BRIEF DESCRIPTION OF THE DRAWINGS

For a better understanding of the nature and objects of the invention, reference should be made to the following detailed description taken in conjunction with the accompanying drawings, in which.

Like reference numerals refer to corresponding parts throughout the several views of the drawings.

DETAILED DESCRIPTION OF THE INVENTION

Figure 1:
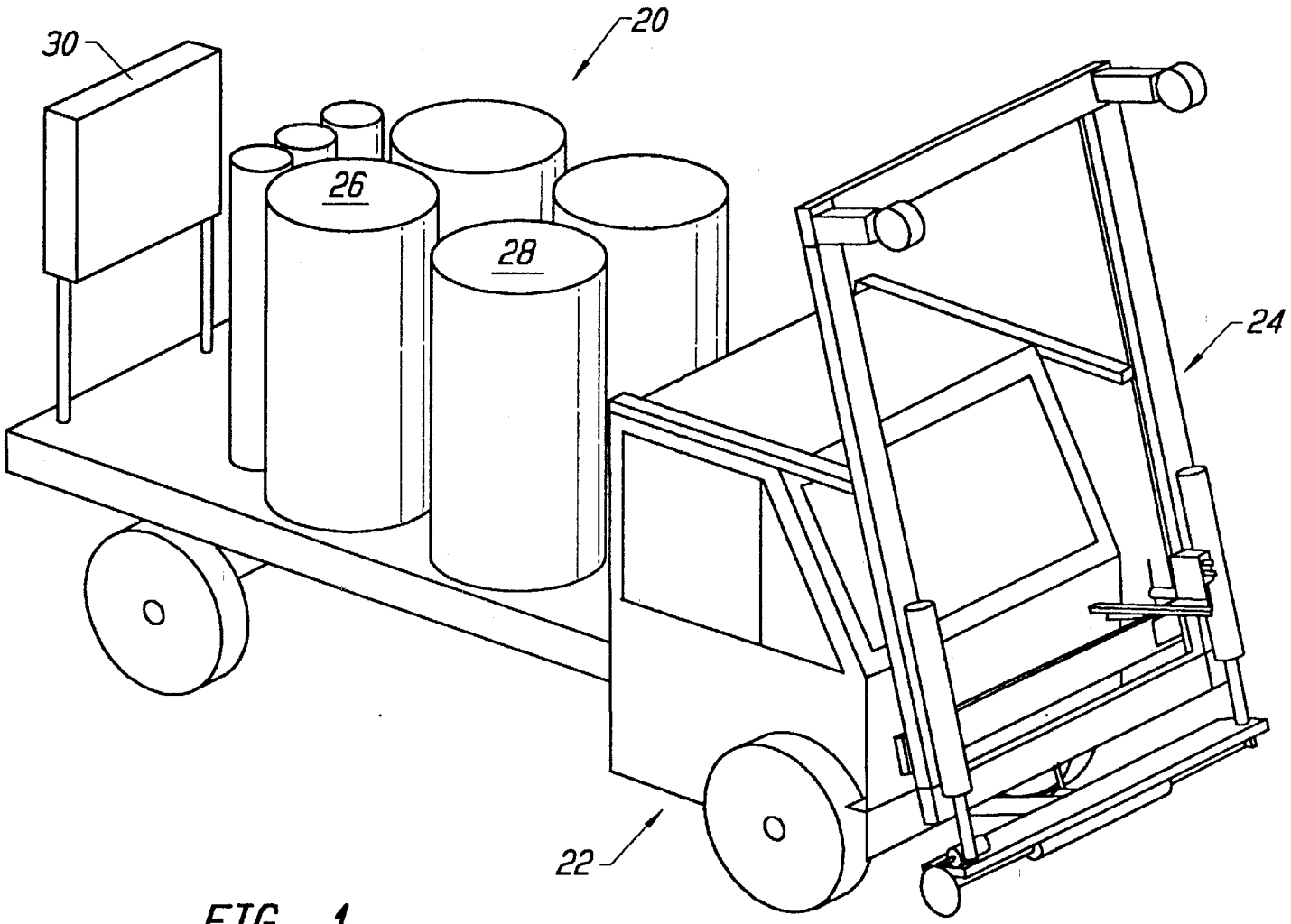
FIG. 1 is a perspective view of a preferred embodiment of a transportable surface marking apparatus in accordance with the invention.

A transportable surface marking arrangement 20 in accordance with the invention is depicted in FIG. 1. The arrangement 20 includes a transport vehicle 22 that supports a surface marking mechanism 24. The surface marking mechanism 24 is shown in a retracted position that allows the transport vehicle 22 to conveniently move to a location that requires the application of a pattern to a selected surface. At the selected location, the surface marking mechanism 24 is lowered into a horizontal working position, as shown and discussed below.

The transport vehicle 22 preferably carries a liquid material container 26 and a solid material container 28. Delivery lines (not shown) convey viscous material, such as paint, from the liquid material container 26 and flowable solid material, such as glass beads, from the solid material container 28 to the surface marking mechanism 24. Conventional means may be used to achieve the material delivery.

As will be described below, the surface marking mechanism 24 automatically applies the materials, in a selected pattern, to the surface beneath the surface marking mechanism 24. This is accomplished without a worker leaving the interior of the transport vehicle 22. During the application process, a hazard signal 30 may be activated to warn vehicular traffic that work is in progress.

A number of benefits associated with the invention are immediately cognizable. First, the invention does not require stencils since the pattern is automatically applied by the surface marking mechanism 24. In the absence of stencils, a number of problems are obviated. First, the transport vehicle 22 is not limited by the number of stencils it can carry. The stencils do not have to be manually positioned. Workers are not required to place barriers around the area to be marked. In addition, workers are not required to work in hazardous proximity to vehicular traffic. Finally, the invention avoids labor overhead associated with cleaning stencils.

Additional benefits associated with the invention will be appreciated as the invention is fully described below. It will be seen that the invention automatically provides for a uniform application of paint, thereby eliminating the problems associated with manual application of paint. It will also be demonstrated that the invention can simultaneously apply paint and glass beads. Thus, a marking job can be completed more efficiently. Moreover, fast-drying paint may be used in the pavement marking process, thereby allowing the swift completion of a job and eliminating the requirement to return to a job to remove barriers.

Figure 2:
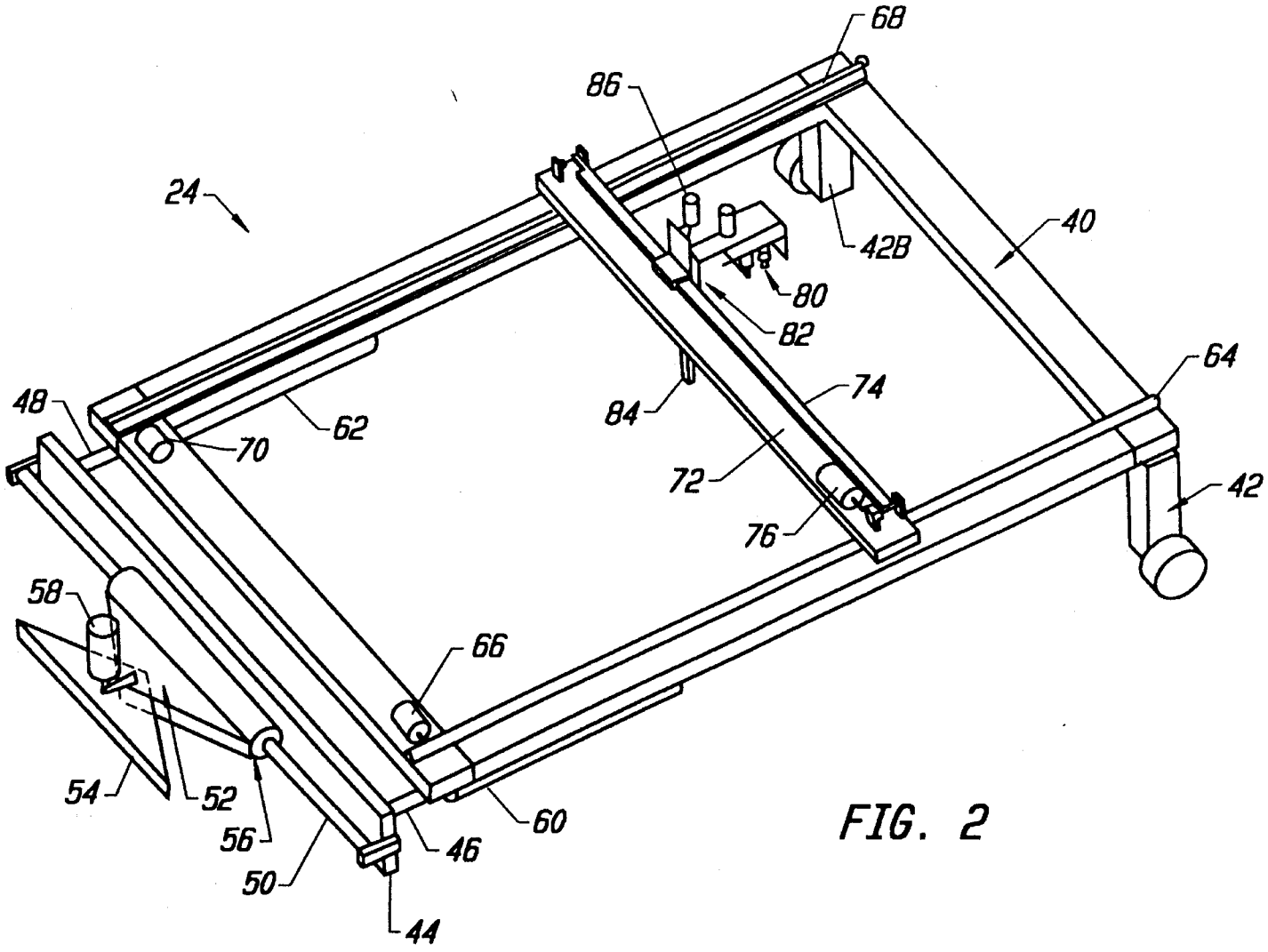
FIG. 2 is a perspective view of the surface marking mechanism of FIG. 1.

The invention and its benefits are more fully appreciated with reference to FIG. 2. FIG. 2 depicts the surface marking mechanism 24 in a horizontal working position over a surface. The surface marking mechanism 24 includes a surface marking frame 40 in a horizontal plane. The surface marking frame 40 is supported at one end by vertical frame supports 42A and 42B. The frame 40 is supported at an opposite end by a horizontal frame support 44. The horizontal frame support 44 includes a first extending horizontal frame support piston 46 and a second extending horizontal frame support piston 48. The horizontal frame support 44 is coupled to a lateral piston 50, which in turn is coupled to a support plate 52. An anchor plate 54 is attached to the transport vehicle 22 (not shown) at one end and to the support plate 52 at an opposite end. The anchor plate 54 provides means for securing the surface marking mechanism 24 to the transport vehicle 22.

A lateral drive hydraulic cylinder 56 is positioned around lateral piston 50 to provide lateral movement of the surface marking frame 40. A frame rotation drive motor 58, positioned on anchor plate 54, is preferably used to rotate the support plate 52 and thus the surface marking frame 40.

A first frame support hydraulic cylinder 60 is positioned over the first extending horizontal piston 46 to provide forward extension of the surface marking frame. Similarly, a second frame hydraulic cylinder 62 is positioned over the second extending horizontal piston 48.

A first forward lead screw 64 is positioned on top of the surface marking frame 40. The first forward lead screw 64 is rotated by a first lead screw drive device 66. Similarly a second forward lead screw 68 is rotated by a second lead screw drive device 70. The first and second forward lead screws 64 and 68 transport cross beam 72. Cross-beam 72 supports a cross beam lead screw 74 and a cross beam lead screw drive 76 that transports a dispenser 80 in a lateral direction. The dispenser 80 includes an elevation adjustment assembly 82 which includes an elevation lead screw 84 and an elevation lead screw drive 86.

As indicated in the foregoing discussion, the surface marking mechanism 24 of the invention may be moved in a number of directions. The frame rotation drive motor 58 provides for rotational movement of the frame 40. The lateral drive hydraulic cylinder 56 enables lateral movement of the frame 40. The first and second horizontal piston hydraulic cylinders 60 and 62 provide forward and backward thrust for the frame 40. The foregoing devices are used to position the frame 40 prior to marking and to reposition the frame 40 to finish a pattern that does not fit within the perimeter of the frame 40.

The remaining dimensional movement is used to manipulate the dispenser 80 during the process of marking a surface. The first and second lead screw drive devices 70 and 66 are used to provide forward and backward frame interior motion. The cross beam lead screw drive 76 enables lateral frame interior motion. The elevational lead screw drive 86 provides elevational motion for the dispenser 80.

Figure 3:
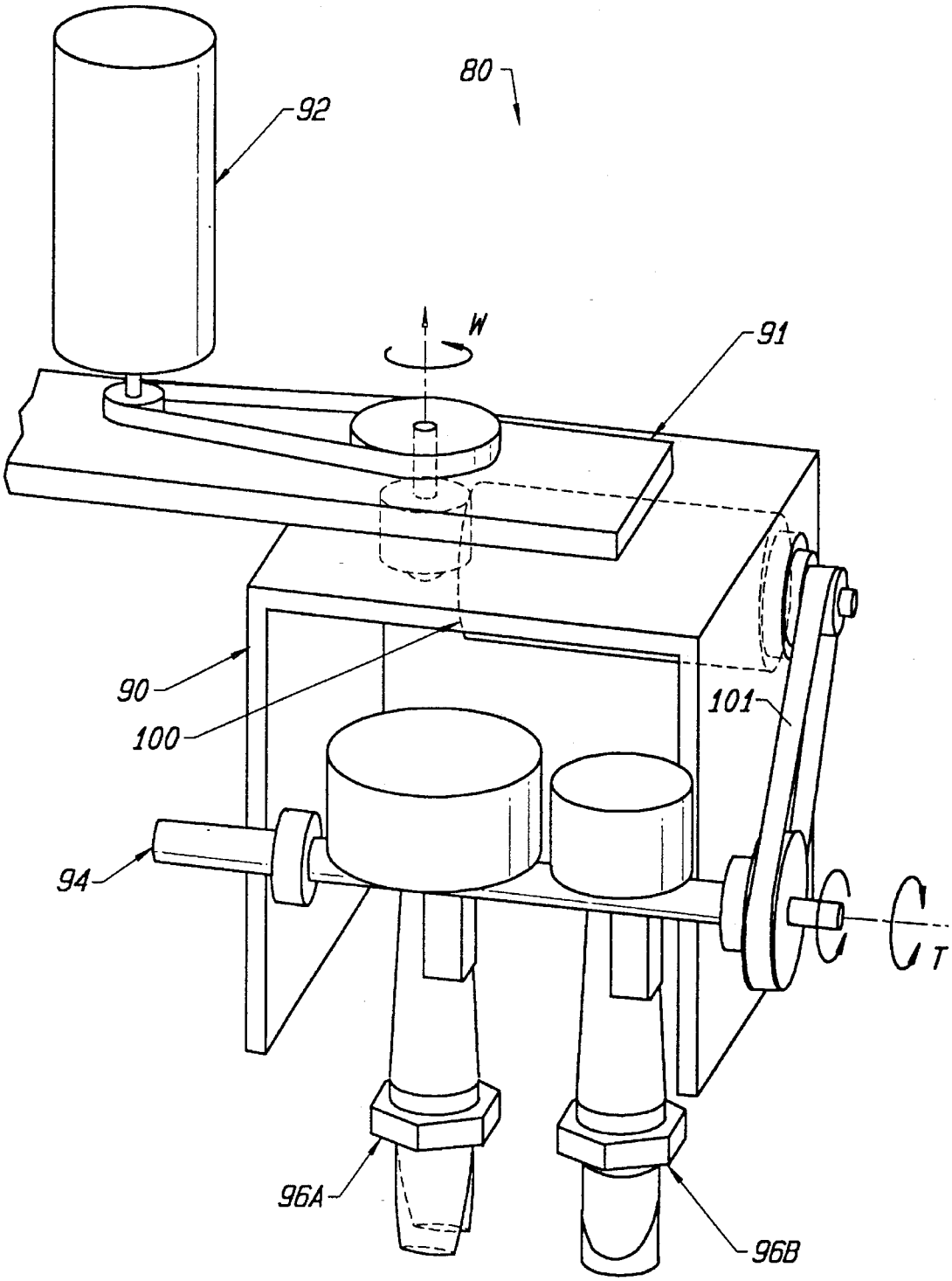
FIG. 3 is an enlarged side view of a preferred dispenser in accordance with the invention.

Additional dimensional movement is provided by the dispenser 80, which is depicted in FIG. 3. The dispenser 80 provides a tilt motion and a marking rotation motion. The marking rotation motion is denominated "W" and is shown in FIG. 3. Reference is made herein to rotating around the W-axis.

The dispenser 80 includes a dispenser frame 90 that is connected to a mounting plate 91. The mounting plate supports a dispenser rotation motor 92 that provides rotational movement for the dispenser frame 90.

The dispenser frame 90 holds a shaft 94 that supports a first dispensing head 96A that may be used to dispense liquid materials and a second dispensing head 96B that may be used to dispense solid flowable materials, such as glass beads. A tilt angle motor 100 rotates belt 101 to apply a tilt angle to the shaft 94. Accordingly, the first dispensing head 96A and the second dispensing head 96B are tilted by the tilt angle motor 100.

Figure 4:
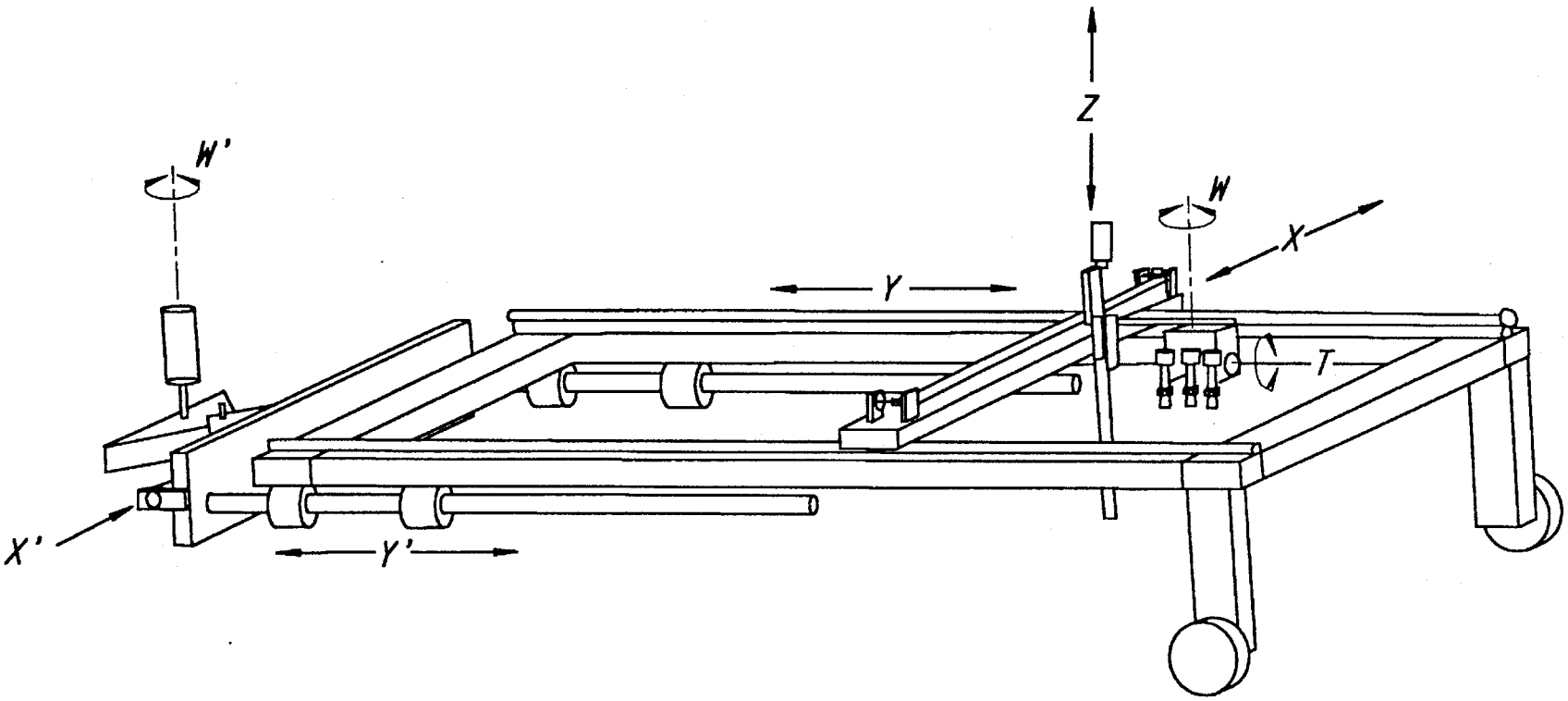
FIG. 4 depicts the various axes of movement associated with the surface marking mechanism of FIG. 1.

FIG. 4 depicts the different dimensions of movement associated with a preferred embodiment of the surface marking mechanism 24 of the invention. As previously discussed, there is dimensional movement to initially position the surface marking frame 40, and there is dimensional movement to position the dispenser 80 during the pavement marking process. Initially considering the movement of the dispenser 80, a y-axis is defined in the forward-backward direction. Movement along the y-axis is provided by the first lead screw drive device 66 and the second lead screw drive device 70. An x-axis is defined in the lateral direction. Movement along the x-axis is provided by the cross beam lead screw drive 76. Thus, means for manipulating the dispenser include the first lead screw drive device 66, the second lead screw drive device 70, and the cross beam lead screw drive device 76. A z-axis is defined in the elevational direction. Means for moving the dispenser 80 along the z-axis include the elevation lead screw drive 86. In addition to movement in the conventional x-, y-, and z- axes, movement is provided in a rotational axis denominated the w-axis. Means for rotating the dispenser 80 around the w-axis include the dispenser rotation motor 92. Finally, movement on a tilt axis, T, for the dispenser 80 is provided by tilting means including a tilt angle motor 100.

Movement for initially positioning the surface marking frame 40 is provided in three dimensions. Forward and backward motion in a y'-axis is provided by the first and second horizontal piston hydraulic cylinders 60 and 62. Lateral motion in the x'-axis is provided by the lateral drive hydraulic cylinder 56. Finally, rotational motion in the w'-axis is provided by the frame rotation drive motor 58 (pivot means). The first and second horizontal piston hydraulic cylinders 60, 62, the lateral drive hydraulic cylinder 56, and the frame rotation drive motor 58 constitute means for positioning the surface marking frame 40.

The various pistons, hydraulic cylinders, lead screws, and drive motors associated with the invention are all known in the art. It should be appreciated that each hydraulic cylinder and drive motor includes an encoding device for position monitoring. Such encoding devices and their connections to supervisory computing units are known in the art. The present invention is not directed to movement, encoding, or computing devices per se, rather the invention is directed toward the novel combination of these elements in the transportable surface marking apparatus of the invention. Now that the physical elements of the invention have been described, attention turns to the control of the physical elements to implement the surface marking methodology of the invention.

Initially, attention turns to the motion control associated with the actual marking of a surface. It can be readily appreciated how the x- and y-axes are necessary to accomplish the marking of a surface. The x-and y-axes position the dispenser 80 in a horizontal plane above the surface to be marked.

Figure 5:
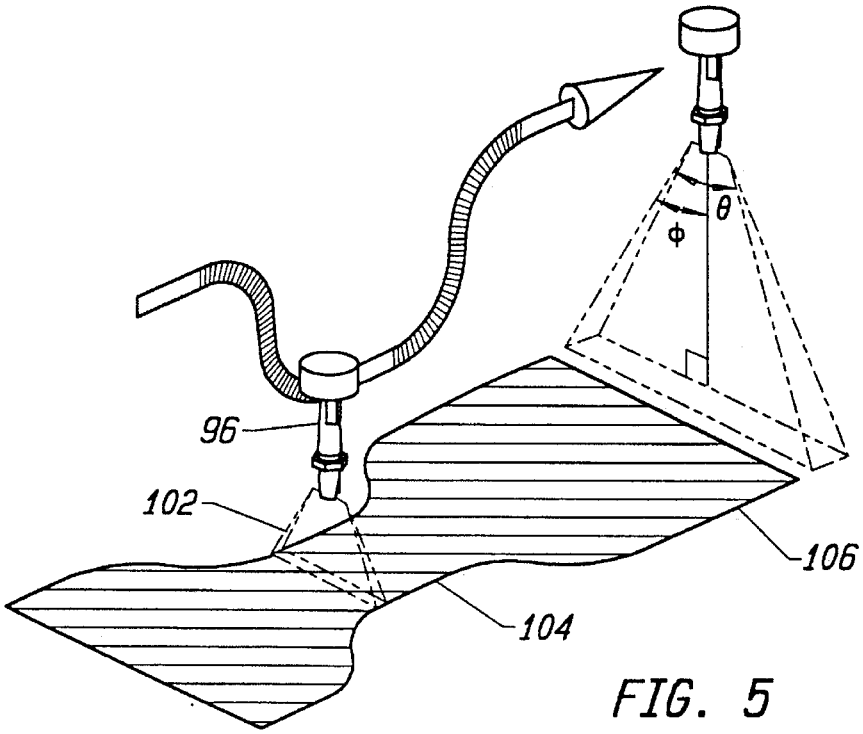
FIG. 5 depicts how the width of an imprinted surface is a function of the elevation (z-axis) of the dispenser.

The z-axis is useful because it allows lines of different thickness to be applied to a surface. This phenomenon is demonstrated in relation to FIG. 5. FIG. 5 depicts a dispensing head (96A or 96B) and the spray pattern 102 that it produces. In the middle of the figure, the dispensing head is close to the surface and therefore produces a narrow marking 104. On the right side of the figure, the dispensing head is relatively farther from the surface and therefore produces a wider marking 106. It should be appreciated that the z-axis can be eliminated if one is willing to generate wide markings through repetitive motions in the x- and y-axes.

FIG. 5 also depicts the relatively wide fan width angle, θ, associated with the present invention. The machine control accuracy associated with the dispensing heads allows this feature. In the absence of machine control accuracy, the fan width angle is relatively small to insure greater accuracy. A spray angle, ϕ, is indicated in FIG. 5. The fan width angle is equivalent to two times the spray angle indicated in the figure.

Manually operated dispensing heads typically have a fan width angle of 30° to 40°. The present invention allows a fan width angle of between 0° and 180°, preferably between 60° to 100°, and preferably approximately 80°. The larger fan width angle permits broader painting strokes, allowing for more rapid job completion.

Figure 6:
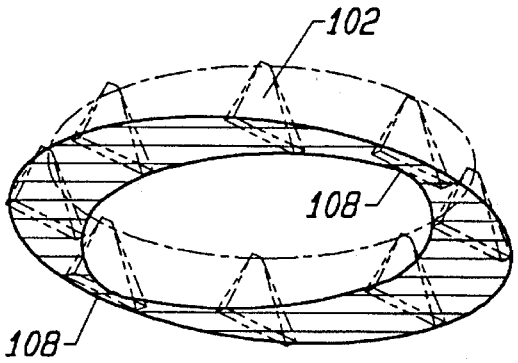
FIG. 6 illustrates the problem associated with a dispenser that does not rotate (w-axis).
Figure 7:
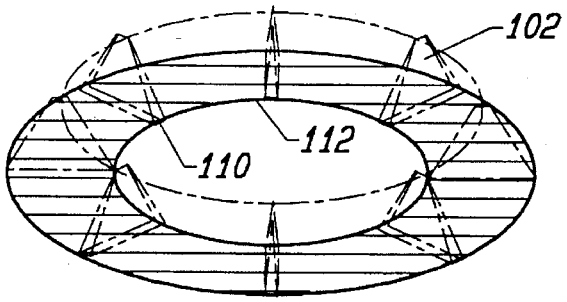
FIG. 7 illustrates the correction of the problem identified in FIG. 6.

FIG. 6 demonstrates a problem associated with a dispensing head that only moves in x- and y-axes. A fixed position dispenser 80 that moves in the x- and y-axes to form a circle will produce a marked circle with flat ends 108. To solve this problem, the w-axis is used to provide rotation of the dispenser 80. Specifically, the dispenser 80, through control of the dispenser rotation motor 92, is continuously positioned so that the interior edge 110 of the spray pattern 102 is always normal (perpendicular) to the interior line 112 to be marked, as shown in FIG. 7.

Figure 8:
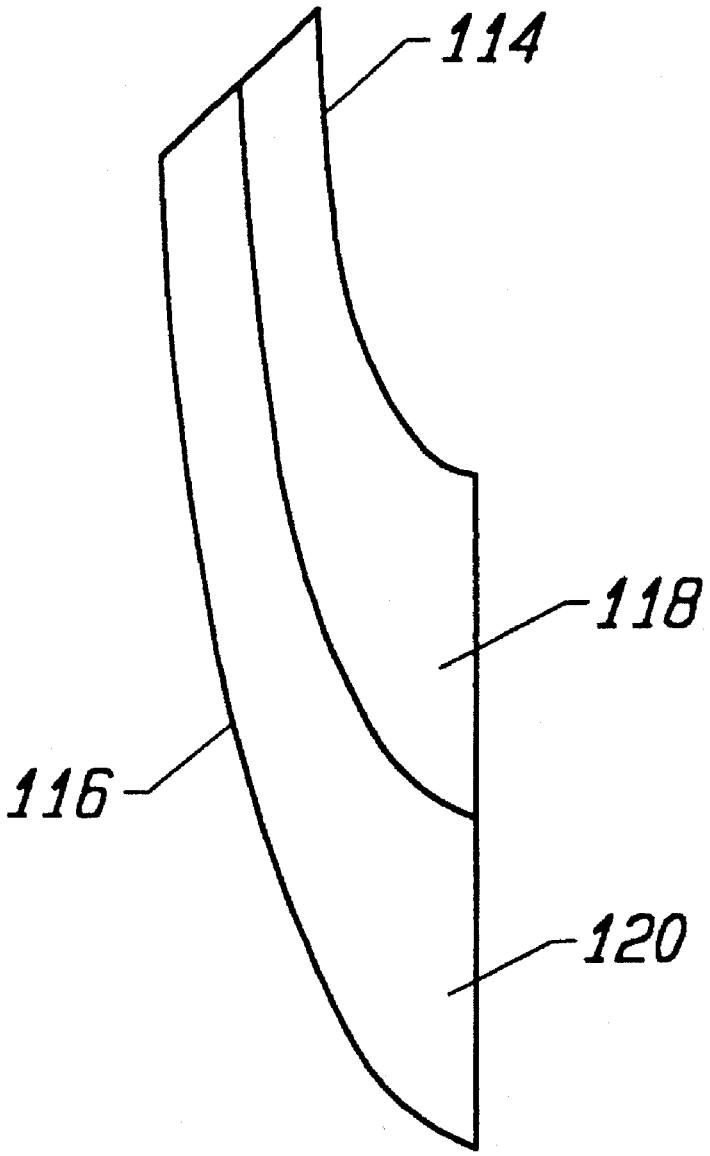
FIG. 8 illustrates the problem of un-even paint application on curved surfaces, thereby necessitating the tilt-axis control of the present invention.

FIG. 8 demonstrates a problem associated with dispensing a substance along a curved surface. The radius of curvature of the inside curve 114 is different than the radius of curvature of the outside curve 116. As a result, a contracted perimeter region 118 and an extended perimeter region 116 are formed. Uniform application of a flowable material to the pattern of FIG. 8 results in too much material being applied to the contracted perimeter region 118 and too little material being applied to the extended perimeter region 116. The tilt-axis is provided to overcome this problem. The axis positions the dispenser head 96A or 96B so that the resultant spray pattern deposits a uniform amount of material across the pattern, as will be further described below.

Attention now briefly turns to the motion control associated with positioning of the surface marking frame 40. This positioning scheme relates to the x'-, y'-, and w'-axes. These axes are manipulated for two purposes: (1) to initially position the surface marking frame 40 prior to surface marking; and (2) to re-position the surface marking frame 40 when the pattern to be produced is not completely contained within the traverse dimensions of the surface marking frame 40. These two situations will be discussed in detail below.

Figure 9:
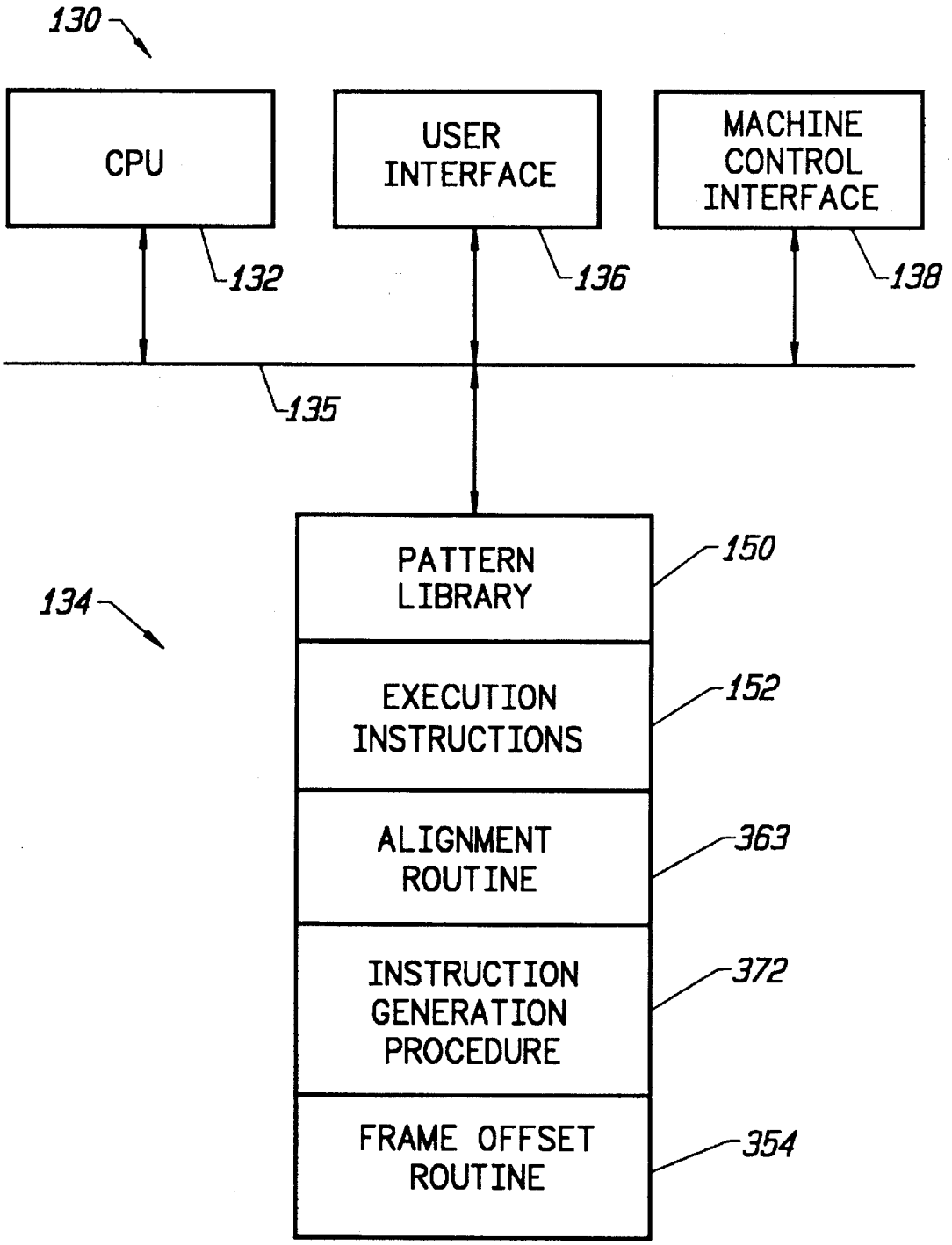
FIG. 9 depicts a functional block diagram of the computer control devices of the invention.

Attention now turns to the control aspects associated with the hardware of the invention. FIG. 9 depicts a functional block diagram of the controller 130 of the invention. The controller 130 includes a central processing unit (CPU) 132 that communicates with a memory module 134 over a bus 135. The CPU 132, memory module 134, and bus 135 are standard computing elements widely known in the art. The memory module 134 may be RAM, ROM, or other memory. As will be described below, the memory module 134 stores coded programs for executing the method of the present invention. The apparatus 130 also includes a user interface 136 that preferably includes a monitor and a keyboard. A preferable user interface 136 is described in relation to FIG. 10. The apparatus 130 also includes a machine control interface 138 that communicates with the CPU 132 over bus 135 and with the various encoders that drive the previously described movement devices, such as the hydraulic cylinders and the motors.

Figure 10:
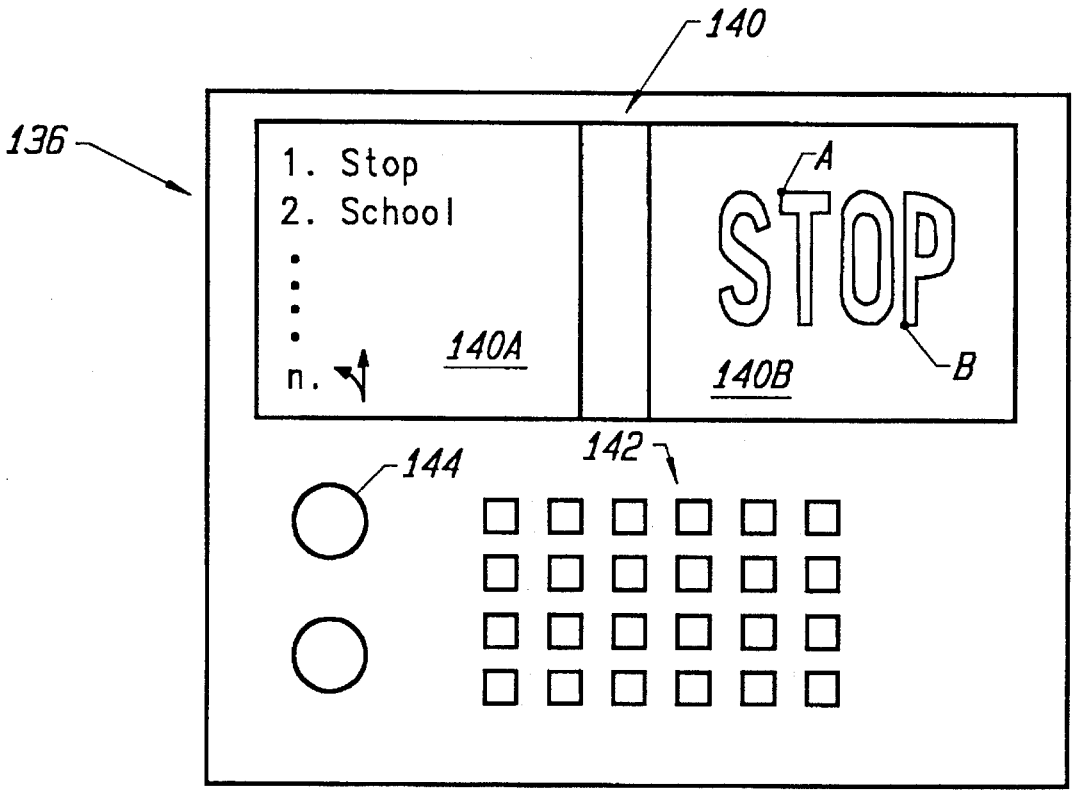
FIG. 10 depicts a control display apparatus that may be used in accordance with the invention.

FIG. 10 depicts a user interface 136 that may be used in accordance with the invention. The user interface includes a monitor 140. One side of the monitor 140A preferably displays a list of symbols. The other side of the monitor 140B preferably displays a selected symbol. The monitor 140 preferably includes a plurality of input keys 142 which may include symbols such as arrows, letters, and numbers. In addition, the monitor 140 preferably includes a cursor manipulation device 144, such as a track ball, joystick, or mouse.

FIG. 9 shows a pattern library 150 stored in memory unit 134. The pattern library 150 stores informational patterns that may be drawn by the apparatus of the invention. The informational patterns are displayed on the monitor 140, as shown in FIG. 10. In particular, FIG. 10 shows that a "Stop", "School", or "left-thru-arrow" pattern may be selected. A particular pattern is selected by the cursor manipulation device 144 or the input keys 142, using standard techniques. (In the alternative, a touch-screen may be used.) The selected pattern is then displayed, as shown in FIG. 10. Each pattern has a corresponding set of execution (or machine control) instructions. The execution instructions may be generated in real-time or stored as a data set, as shown at block 152 in FIG. 9. The execution instructions generate a set of control signals for the various movement devices associated with the surface marking mechanism 24. For instance, the execution instructions will force the movement devices to control the dispenser 80 such that the word "stop" is formed on a selected surface.

The execution instructions may be in the form of a set of computer numeric control instructions. By way of example, the invention will be disclosed in pseudo code. In the pseudo code, a sequence of destination points are defined in an x- and y-plane. The path the system takes to a destination point is defined by either RAPID, LINEAR, CIRCLE1, or CIRCLE2 commands. The RAPID command produces a linear movement that is automatically executed by the control system to move to the designated destination point. The path the system uses to arrive at the destination point is not important, therefore, the system attempts to optimize the path for speed.

The LINEAR command produces a linear movement where all specified axes arrive at the destination coordinates at exactly the same time. The CIRCLE1 command generates a clockwise arc, while the CIRCLE2 command generates a counterclockwise arc. The circle commands utilize a coordinate defining the center of the arc. These coordinates are defined as follows: $I=(X_{origin}-X_{start})$ and $J=(Y_{origin}-Y_{start})$. The $X_{origin}$ point is the X value at the origin of the arc segment to be drawn. The $X_{start}$ point is the X value at the starting point of the arc.

In addition to the motion in the x- and y-plane, motion can be effected in the elevational plane (the z-axis) by defining a Z-coordinate. Similarly, a rotation value for the dispenser 80 may be defined with a W-coordinate, and a tilt angle for the dispensing heads may be defined with a tilt-angle value "T". The pseudo code also allows movement speed in the x- and y-plane to be defined with an "F" command. Finally, an M1=0 command turns the dispenser off and an M1=1 command turns the dispenser on.

Figure 11:
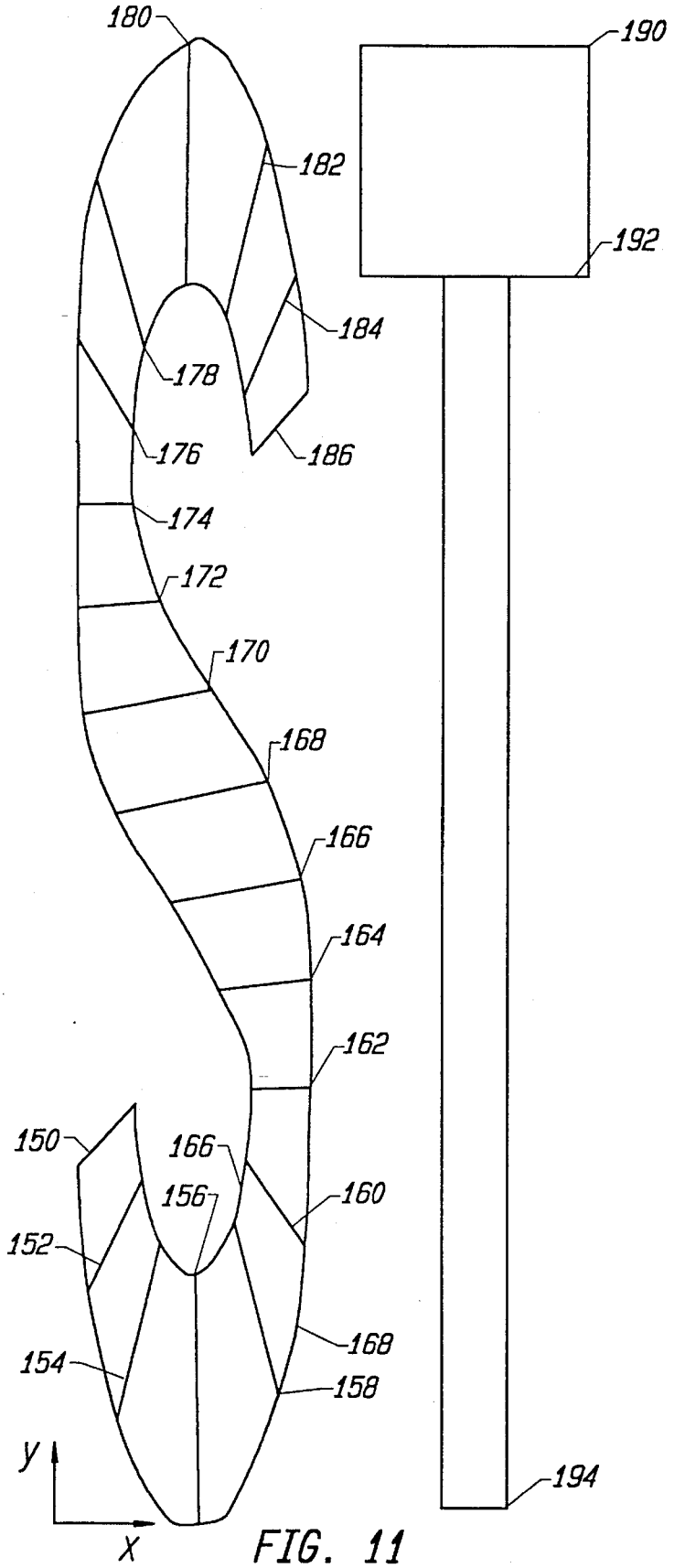
FIG. 11 illustrates the marking of a first pattern in accordance with the invention.

A pseudo code implementation of the invention will now be described in relation to an example. FIG. 11 shows the first two letters of a "stop" marking to be applied to a surface. The following code segment may be used to draw the first portion of the letter "s".

(1) M1=0
(2) F1000.00
(3) RAPID
(4) F441.94
(5) X1.14 Y24.18 Z3.01 W45.0 T11.74
(6) LINEAR M1=1
(7) F264.29
(8)CIRCLE2
(9) X1.69 Y16.72 I52.74 J24.19 Z5.02 W67.40 T11.83
(10) F184.00
(11) X3.37 79.60 I42.03 J22.50 Z7.29 W79.26 T11.04
(12) F146.31
(13) X7.68 Y4.10 I10.98 J11.12 Z9.18 W90.00 T10.85
(14) F201.61
(15) X12.39 Y10.53 I3.62 J12.01 Z6.55 W103.67 T12.19
(16) F344.60
(17) X14.01 Y19.09 I-36.75 J24.24 Z3.82 W123.00 T12.44
(18) F625.00
(19) X13.50 Y27.85 I-17.14 J21.70 Z2.29 W180.0 T0.95
(20) F415.48
(21) LINEAR

The first line of code initializes the dispenser to an off position. The second line of code initializes the motion speed to 1000.00 inches/sec. The third line of code has the RAPID instruction. The fourth line of code describes the speed for the RAPID motion and the fifth line of code describes the destination x- and y-coordinates (in inches) for the RAPID motion. Line 150 in FIG. 11 shows the destination position for this command. The lines in the pattern, such as line 150, will also be referred to herein as destination segment lines. The designated coordinates are at the center of destination segment line 150, as will be described below. Line five also includes a z-coordinate value (3.01 inches), a w-coordinate value (45°), and a tilt angle (11.83°). The lower left-hand corner of FIG. 11 includes x- and y-axes for context. Note that line 150 is a 45° angle at an x-coordinate value of 1.14 inches and a y-coordinate value of 24.18 inches.

Line six indicates that the dispenser is turned on at the destination of line 5. Note that when the dispenser is turned on the dispenser is in motion (441.94 inches/sec). This feature insures that a uniform amount of material is dispensed. If a dispenser head is turned on in a stationary position, an excess material build-up results at the position. Thus, in accordance with the invention, it is preferable to establish a predetermined initial velocity prior to turning on a dispenser head.

Line seven describes a speed that should be used to reach the coordinates defined in line nine. Line eight identifies that the motion to the coordinates in line nine is circular in a counter-clockwise direction (CIRCLE2). The coordinates of line nine are identified in FIG. 11 as line 152. Similarly, the coordinates of line eleven correspond to line 154 in FIG. 11, and the coordinates of line thirteen correspond to line 156 in FIG. 11. Note the change in values associated with line thirteen. The rotation axis (W) is at ninety degrees, identifying the vertical line 156. Also note in line 12 the relatively slow speed (146.31 inches/sec) required for this relatively thick portion of the letter.

Line fifteen describes the center-line x- and y-coordinates associated with segment 158 in FIG. 11, and line seventeen describes the center-line coordinates associated with segment 160 in FIG. 11. Note the relatively large tilt angle in seventeen. As will be further described below, the tilt angle is a function of the radius of curvature between the left perimeter line 166 and the right perimeter line 168. Note in line nineteen that the tilt angle is very small, corresponding to an almost linear block between lines 160 and 162.

Line 21 defines a linear command that is to be followed for a number of subsequent blocks. The subsequent block processing is defined as follows:

(22) X12.54 Y34.54 Z3.44 W183.69 T0.63
(23) F263.78
(24) X10.71 Y40.93 Z5.42 3188.44 T0.96
(25) F229.62
(26) X7.83 Y47.11 Z6.23 W190.46 T0.83
(27) F263.78
(28) X4.60 Y53.24 Z5.42 W188.44 T-1.24
(29) F415.48
(30) X2.75 Y59.63 Z3.44 W183.69 T-1.25
(31) F625.00
(32) X1.79 Y66.32 Z2.28 W180.00 T-1.90
(33) F345.20
(34) CIRCLE1

The coordinates of line twenty-two correspond to the center point of line 164. Line twenty-six corresponds to line segment 168 in FIG. 11. Note the relatively large z-value at this line, which is necessary to form the broad portion of the "s". Also note the corresponding low speed (229.62) defined at line twenty-five, which is necessary to insure an adequate amount of material is distributed over this larger area. Linear segments up to line 174 are formed. Thereafter, additional circular processing is required, as defined at line thirty-four. The additional circular processing may be executed with the following code.

(35) X1.27 Y75.64 I48.60 J73.59 Z3.84 W122.87 T-11.93
(36) F211.03
(37) X2.81 Y85.24 I50.59 J72.70 Z6.17 W105.15 T-13.25
(38) F146.31
(39) X7.68 Y91.86 I11.38 J84.03 Z9.20 W90.0 T-10.68
(40) F184.00
(41) X11.88 Y85.83 I2.55 J83.80 Z7.49 W79.26 T-8.39
(42) F264.29
(43) X13.67 Y79.28 I-12.63 J75.60 Z5.02 W67.40 T-11.86
(44) F441.94
(45) X14.22 Y71.82 I-36.98 J71.85 Z3.01 W45.00 T-11.74
(46) M1=0

Line thirty-five corresponds with destination segment line 176 in FIG. 11. Similarly, line thirty-seven corresponds with segment 178, line thirty-nine corresponds with segment 180, line forty-one corresponds with segment 182, line forty-three corresponds with segment 184, and line forty-five corresponds with segment 186. Note that at segment 180, the rotation axis is 90°, the z-axis value is relatively high (9.20) and the dispenser velocity is relative low (146.31). Line forty-six instructs the dispensing heads to be shut-off since the last portion of the letter "s" has been written.

The following code describes instructions for forming the letter "T".

(47) RAPID
(48) F156.25
(49) X26.88 Y96.00 Z9.15 W0.0 T0.0
(50) LINEAR M=1
(51) F156.25
(52) X26.88 Y80.64 Z9.19 W0.0 T0.0
(53) M1=0
(54) RAPID
(55) F625.00
(56) X26.88 Y80.64 Z2.29 W0.0 T0.0
(57) M1=1
(58) F625.00
(59) X26.88 Y80.00 Z2.29 W0.0 T0.0
(60) M1=0

The RAPID command at line forty-seven directs the dispenser at the speed specified at line forty-eight (156.25) to the coordinates defined at line forty-nine. The x- and y-coordinates of line forty-nine represent the center line of segment 190. At this location, the dispensing head is turned on, as indicated at line fifty. Again, note that the dispensing head will be turned on while the dispenser is in motion.

Line fifty-two defines coordinates corresponding to line segment 192. At this point, the dispensing head is shut off (M1=0 at line 53). The RAPID command is once again invoked at line fifty-four so as to move the dispenser to the coordinates at line fifty-six. Note that the x- and y-coordinates at line fifty-six are the same as those at line fifty-two. Thus, the purpose of the RAPID command is to actually change the speed of the dispenser as described in line fifty-five. In other words, the dispenser was already positioned at segment 192 in FIG. 11, the RAPID command at line fifty-four did not necessitate repositioning of the dispenser because it was already where it had to be, however, since a large speed was required, the RAPID command will force some type of movement with the dispenser so that when it is at the segment 192 it has the proper speed.

Line fifty-six describes the coordinates to draw the section between lines 192 and 194 in FIG. 11. When the line 194 is reached, the dispenser head is turned off, as indicated at line sixty.

Note that the narrow section of the letter "T" corresponds to a low z-value (2.29), compared to cross-segment of the "T" which has a high z-value (9.15) Also note that the dispenser had to be turned off at line fifty-three. This was necessary to accommodate the change in the z-value. A continuous motion for the z-value produces sloping left and right perimeters lines, as seen between segments 164 and 174 of the letter "S". Since the letter "T" is completely linear, the foregoing code does not include rotation (w-axis) or tilt ("T") values.

Figure 12:
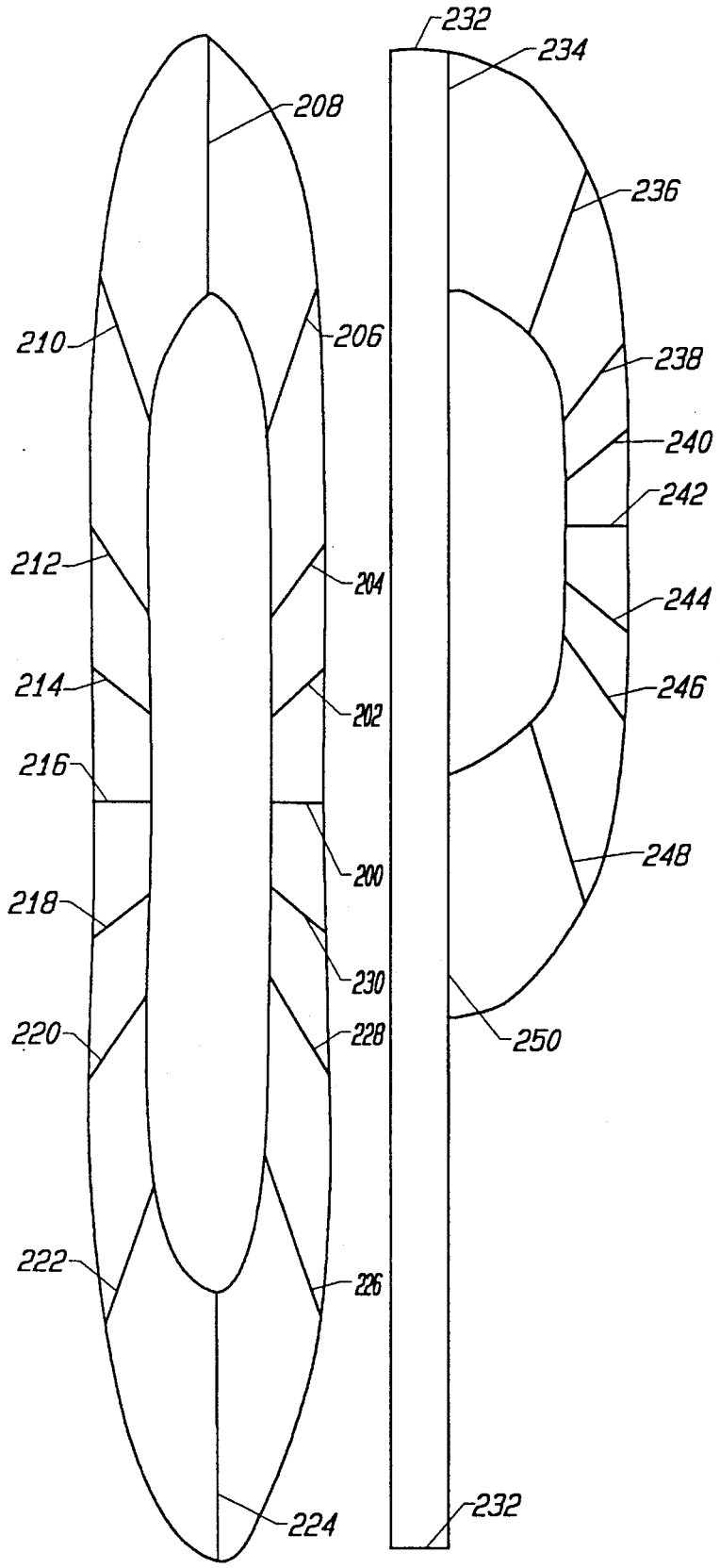
FIG. 12 illustrates the marking of a second pattern in accordance with the invention.

The following code is used to write the "0" of FIG. 12.

(61) RAPID
(62) F625.00
(63) X52.31 Y48.0 Z2.23 W0.0 T-6.97 (200)
(64) LINEAR M1=1
(65) F497.75
(66) X52.31 Y55.46 Z2.8 W37.21 T-6.97 (202)
(67) F343.71
(68) X52.31 Y62.93 Z4.06 W56.64 T-6.96 (204)
(69) F165.55
(70) CIRCLE2
X52.30 Y74.47 I-312.96 J68.44 Z6.18 W70.43 T-8.98
(72) F165.55
(73) X46.08 Y90.82 I43.08 J83.89 Z9.51 W90.0 6–7.14 (208)
(74) F221.70
(75) X39.86 774.47 I84.61 J72.70 Z6.18 W109.57 T-8.98
(76) F343.71
(77) X39.84 Y62.94 I395.77 J68.23 Z4.05 W123.36 T-7.07
(78) F497.75
(79) LINEAR
(80) X39.85 Y55.46 Z2.80 W142.79 T-6.97 (214)
(81) F625.0
(82) X39.85 748.0 Z2.23 W180.0 T-6.97 (216)
(83) F497.75
(84) X39.85 Y40.54 Z2.8 W217.21 T-6.97 (218)
(85) F343.71
(86) X39.85 Y33.07 Z4.06 W236.64 T-6.96 (220)
(87) F221.70
(88) CIRCLE2
(89) X39.86 Y21.53 I405.12 J26.56 Z6.18 W250.43 T-8.98

(90) F146.45
(91) X46.08 Y5.15 I49.32 J12.31 Z9.51 W270.0 T-7.14 (224)
(92) F221.70
(93) X52.30 Y21.53 17.55 J23.30 Z6.18 W289.57 T-8.98(226)
(94) F343.71
(95) X52.32 Y33.06 I-303.61 J27.77 Z4.05 W303.36 T-7.07
(96) F497.75
(97) LINEAR
(98) X52.31 740.54 Z2.8 W322.79 T-6.97 (230)
(99) F625.00
(100) X52.31 Y48.0 Z2.23 W360.0 T-6.97 (200)
(101) M1=0

The rapid command at line sixty-one moves the dispenser to the coordinates identified at line sixty-three. The lines of code that indicate a destination point, such as line sixty-three, include a number in parentheses indicating the corresponding mark in the letter "0" of FIG. 12. Note once again that when the command to turn on the dispensing head is set (M1=1 at line sixty-four), the dispensing head is already in motion.

As one would expect, there is symmetry in the values around the letter "0". For example, at lines 71 and 75, corresponding to segments 206 and 210, the y-, z-, and tilt values are the same. Note relatively large tilt angles at these locations. As previously indicated, these tilt angles provide uniform distribution of deposited material. Another way of stating this is that more material is deposited in the regions with more area than in the regions with less area. Thus, the dispensing head is slanted to force one end of the dispensing head closer to the pavement and one end further from the pavement. The closer end traverses a larger perimeter area and deposits material immediately beneath the dispensing head, while the further end sprays the material to the smaller perimeter region. For instance, in the region between 208 and 210 in FIG. 12, the close end of the dispensing head (surface proximate material dispenser position) is positioned at the outside perimeter of the letter "0" while the lifted end of the dispensing head (surface distal material dispenser position) forces material toward the center of the "0". Note that in the linear regions, say between lines seventy-nine and eighty-seven, the tilt angles are equivalent, since there is no compensation for different radius of curvatures between inside and outside lines.

The letter "P" may be written through the following commands.

(102) RAPID
(103) F625.00
(104) X59.52 Y0.00 Z2.29 W360.0 T-0.0 (230)
(105) LINEAR M1=1
(106) F625.00
(107) X59.52 Y96.0 Z2.29 W360.0 T0.0 (232)
(108) M1=0
(109) RAPID
(110) F156.25
(111) X61.44 Y90.64 Z8.8 W270.0 T8.67 (234)
(112) LINEAR M1=1
(113) F211.11
(14) CIRCLE1
(115) X69.18 Y84.72 I59.15 J79.63 Z6.62 W253.95 T6.62
(116) F361.24
(117) X71.70 Y75.50 I53.43 J75.47 Z3.76 W234.73 T9.88
(118) F510.51
(119) LINEAR
(120) X71.70 Y70.39 Z2.66 W215.23 T9.86 (240)
(121) F625.00
(122) X71.70 Y65.28 Z2.17 W180 T9.86 (242)
(123) F510.51
(124) X71.70 Y60.17 Z2.66 W144.77 T9.86 (244)
(125) F361.24
(126) X71.70 Y55.06 Z3.76 W125.27 T9.88 (246)
(127) F211.11
(128) CIRCLE1
(129) X69.18 Y45.84 I53.43 J55.09 Z6.62 W106.05 T6.62
(130) F156.25
(131) X61.44 Y39.92 I59.15 J50.93 Z8.8 W90 0 T8.67 (250)
(132) M1=0

The RAPID command at line one-hundred and two moves the dispenser to line segment 232 of FIG. 12. When the dispenser head is turned on, as commanded at line one-hundred and five, the dispenser head is moving at 625 inches/second. The dispenser then moves at the same speed from a Y-position of 0.0 to a y-position of 96 inches, as indicated at line one-hundred and seven. When the dispensing head reaches segment 232, the dispensing head is turned off and repositioned, as indicated in the foregoing code at lines one-hundred eight to one-hundred eleven. At line one-hundred twelve, the dispensing head is turned on and the round portion of the "P" is completed.

Figure 13:
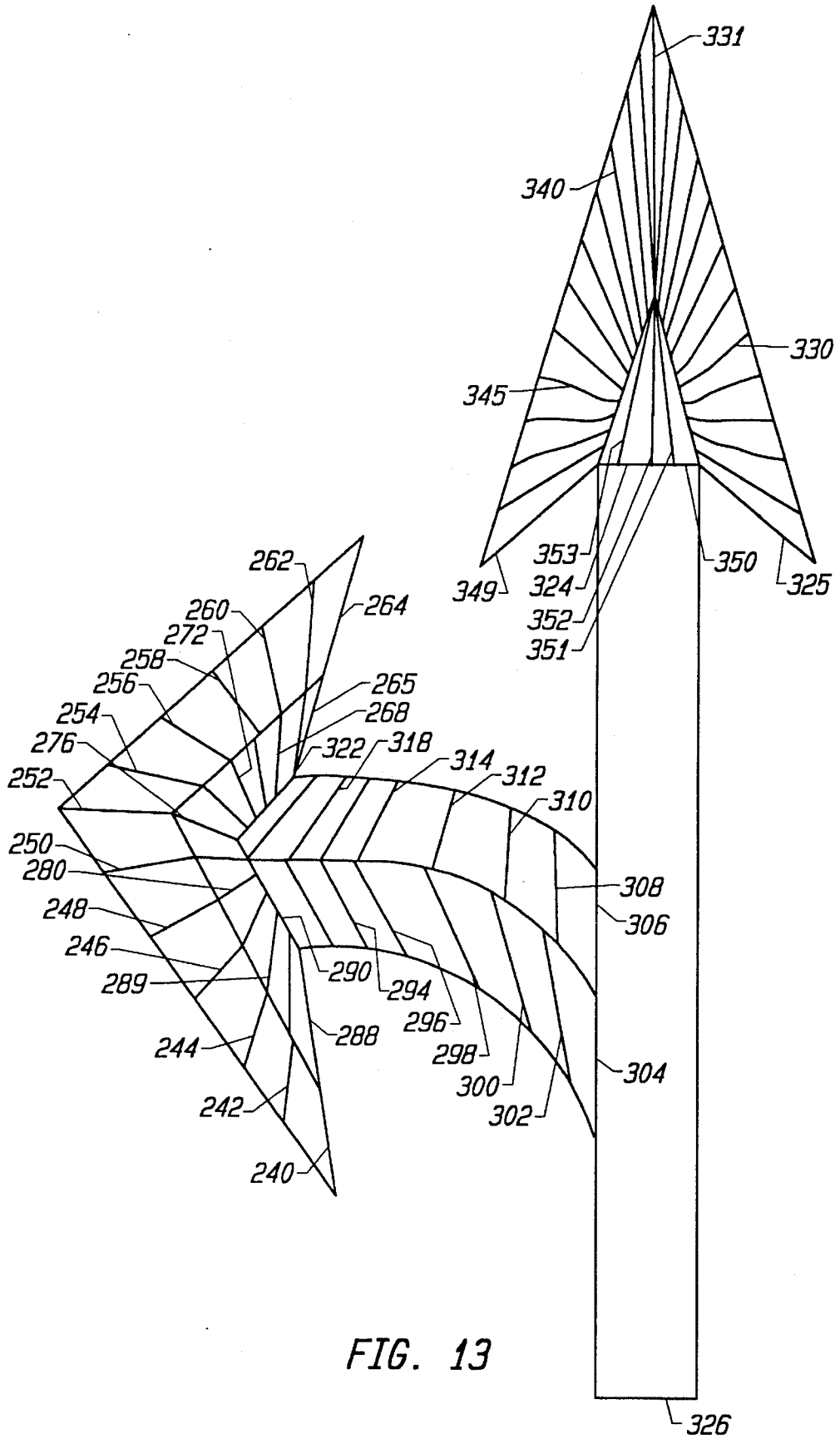
FIG. 13 illustrates the marking of a third pattern in accordance with the invention.

FIG. 13 is used to demonstrate the marking of a "left-thru-arrow". The following code may be used to accomplish this task.

(133) F1000.0
(134) RAPID
(135) F240.00
(136) X26.65 Y24.94 Z5.57 W278.26 T-11.22 (240)
(137) LINEAR M1=1
(138) F290.54
(139) X23.07 Y30.38 Z4.69 W266.74 T-9.68 (242)
(140) F342.25
(141) X19.59 735.69 Z4.02 W250.20 T-8.51 (244)
(142) F366.76
(143) X16.16 740.92 Z3.78 W229.13 T-7.58 (246)
(144) F342.25
(145) X12.77 Y46.08 Z4.08 W208.06 T-6.84 (248)
(146) F290.54
(147) X9.41 Y51.20 Z4.82 W191.52 T-6.23 (250)
(148) F240.00
(149) X5.67 756.29 Z5.76 W180.00 T-8.08 (252)
(150) F298.54
(151) X9.55 Y59.89 Z4.62 W168.50 T-8.41 (254)
(152) F364.29
(153) X13.46 Y63.51 Z3.77 W150.88 T-8.76 (256)
(154) F398.18
(155) X17.39 Y67.15 Z3.44 W127.07 T-9.15 (258)
(156) F364.29
(157) X21.34 Y70.82 Z3.74 W103.25 T-9.57 (260)
(158) F298.54
(159) X25.32 774.51 Z4.54 W85.63 T-10.03 (262)
(160) F240.00
(161) X29.34 778.23 Z5.62 W74.13 T-10.54 (264)
(162) M1=0
(163) RAPID
(164) F188.37
(165) X26.64 768.74 Z6.67 W74.13 T-15.48 (265)
(166) LINEAR M1=1
(167) F222.43
(168) X24.47 Y66.57 Z5.65 W80.09 T-15.48
(169) F266.51

(170) X22.29 Y64.39 Z4.71 W88.55 T-15.48 (268)
(171) F319.70
(172) X20.11 Y62.22 Z3.93 W100.74 T-15.48
(173) F369.39
(174) X17.94 Y60.04 Z3.40 W117.77 T-15.48 (272)
(175) F386.00
(176) X15.76 Y57.87 Z3.26 W138.47 T-15.48
(177) F355.04
(178) X13.59 Y55.69 Z3.54 W158.33 T-15.48 (276)
(179) F485.21
(180) X15.64 Y52.19 Z2.65 W179.04 T-14.04
(181) F558.79
(182) X17.55 Y48.74 Z2.30 W212.84 T-14.04 (280)
(183) F456.49
(184) X19.46 Y45.29 Z2.82 W244.39 T-14.04
(185) F332.67
(186) X21.37 Y41.84 Z3.87 W262.55 T-14.04 (284)
(187) F250.68
(188) X23.28 Y38.39 Z5.13 W272.40 T-14.04
(189) F198.29
(190) X25.20 Y34.94 Z6.49 W278.26 T-14.04 (288)
(191) M1=0

The foregoing code is readily interpreted in view of the discussion in relation to FIGS. 11 and 12. The termination points for each line of code is coordinated with FIG. 13, as specified by the values in the parentheses. The foregoing segment of code only uses the linear command for depositing material. A RAPID command is used to originally position the dispensing head at position 240. The dispensing head is repositioned with a RAPID command at position 265. In both cases, the dispensing head is in motion when the dispense command (M1=1) is invoked.

The following code is used to draw the remaining portion of the arrow.

(192) RAPID
(193) X21.82 Y47.69 Z5.28 W118.19 T0.0 (290)
(194) LINEAR M1=1
(195) F266.91
(196) X25.0 Y47.82 Z5.36 W299.69 T0.94
(197) F264.96
(198) X28.36 Y47.76 Z5.40 W300.34 T0. 48 (294)
(199) F255.31
(200) X31.68 Y47.59 Z5.60 W299.85 T0.47 (296)
(201) F223.92
(202) CIRCLE1
(203) X37.90 Y46.61 I31.65 J27.18 Z6.36 W295.36 T3.03
(204) F202.04
(205) X43.47 Y43.99 I31.45 J25.69 Z6.95 W289.34 T5.97
(206) F184.96
(207) X47.93 Y40.18 I31.67 J25.67 Z7.36 W282.23 T9.61
(208) F168.03
(209) X52.09 Y34.01 I34.17 J26.42 Z6.55 W270.0 T21.57
(210) M1=0
(211) RAPID
(212) F168.03
(213) X52.08 Y44.52 Z8.41 W270.0 T4.70 (306)
(214) LINEAR M1=1
(215) F212.27
(216) CIRCLE2
(217) X48.48 Y47.84 I33.59 J28.06 Z6.73 W272.85 T-1.18
(218) F268.57
(219) X43.74 Y51.11 I31.28 J27.95 Z5.27 W269.12 T-4.55
(220) F307.50
(221) X38.05 Y53.57 I30.36 J27.90 Z4.57 W257.14 T-5.65
(222) F281.65
(223) X31.83 Y54.72 I29.83 J26.69 Z5.01 W242.6 T-4.97
(224) F262.77
(225) LINEAR
(226) X28.75 754.73 Z5.36 W238.42 T-5.53 (316)
(227) F246.75
(228) X25.60 Y54.74 Z5.70 W233.44 T-5.54 (318)
(229) F231.64
(230) X22.45 Y54.73 Z6.07 W228.94 T-5.66 (320)
(231) F217.16
(232) X19.30 Y54.73 Z6.48 W224.98 T-5.66 (322)
(233) M1=0

The following code is used to generate the vertical portion of the arrow.

(234) RAPID
(235) F256.01
(236) X56.77 Y87.54 Z5.59 W0.0 T0.0 (324)
(237) LINEAR M1=1
(238) F256.01
(239) X56.77 Y3.16 Z5.59 W0.0 T0.0 (326)
(240) M1=0

The RAPID command at line two-hundred thirty-four moves the dispenser to segment 324 in FIG. 13. When the dispenser begins to deposit material it is already in motion. The vertical portion is drawn from top (Y=87.54) to bottom (Y=3.16) and then the dispensing head is shut off (M1=0).

The remaining code draws the top of the thru-arrow. In this example, the top of the thru-arrow is not within the interior perimeter of the surface marking frame 40. Therefore, the entire surface marking frame 40 must be moved to accommodate the segment of the pattern that is not within the originally positioned surface marking frame 40. This procedure is illustrated in relation to FIG. 14.

Figure 14:
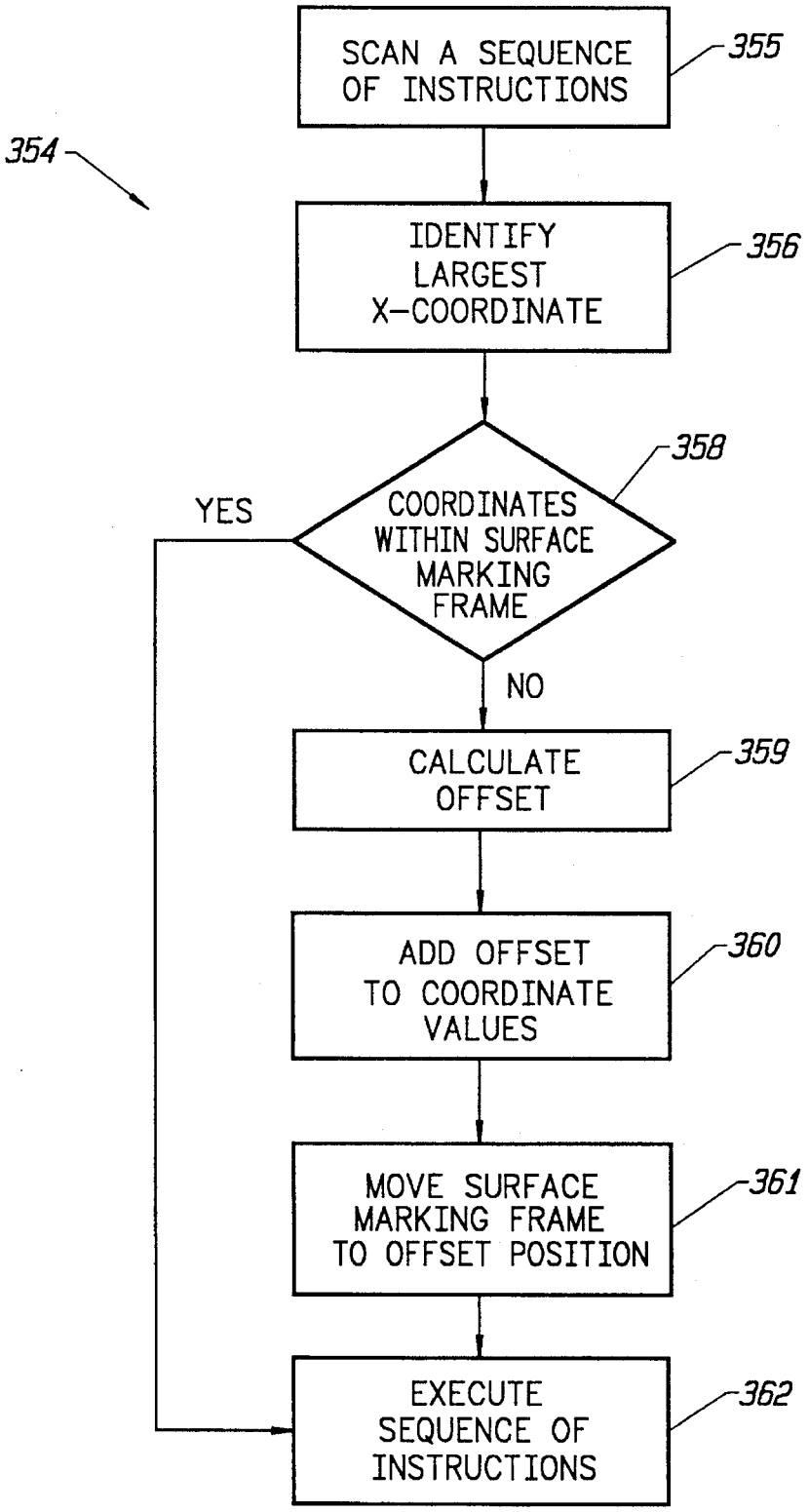
FIG. 14 depicts the control strategy associated with the frame offset routine of the invention.

FIG. 14 depicts a surface marking frame movement routine 354 in accordance with the invention. The first step associated with the routine is to scan a sequence of instructions (block 355). As defined herein, a sequence of instructions includes all instructions performed from the opening (M1=1) to the closing (M1=0) of a dispenser. Lines (194) to (210) above, illustrate this definition.

The next steps associated with the procedure are to identify the largest x-coordinate (block 356) and the largest y-coordinate (block 357) in the sequence of instructions. The next step is to make a decision whether all of the coordinates are positioned within the surface marking frame (decision block 358). By way of example, consider the following code where the largest x-value is 70.16 (line 243) and the largest y-value is 122.92 (line 268). Assume, by way of example, that the interior area of the surface marking frame is 90 inches wide (x-direction) and 110 inches long (y-direction), thereby allowing a pattern of 90 inches by 110 inches to be applied to a surface. In this case, the largest x-value is within the perimeter of the surface marking frame 40. On the other hand, the largest y-value is outside the perimeter of the surface marking frame 40. Since all coordinates are not within the surface marking frame 40, an offset value must be calculated (block 359). To insure that the largest y-coordinate is properly drawn, an offset of at least 12.92 inches must be provided (122.92-110). The selected offset value is then added to every coordinate in the same axis; in other words, all y-values would be supplemented by the offset amount, but the x-values would not be supplemented.

With the offset value established, the next step is to move the surface marking frame to an offset position corresponding to the offset value (block 361). Still relying upon the foregoing example, the surface marking frame 40 would be moved along the y-axis by the selected offset value. Specifically, the first and second horizontal piston hydraulic cylinders 60, 62 would move the frame 40 a distance equivalent to the offset value. With the frame in its new position, the sequence of instructions is executed (block 362).

The following code is an example of non-offset instructions to execute the final portion of the thru-arrow.

(241) RAPID
(242) F166.61
(243) X70.16 Y80.08 Z7.22 W319.40 T-17.79 (325)
(244) LINEAR M1=1
(245) F201.24
(246) X69.04 Y83.65 Z5.98 W327.21 T-17.79 (326)
(247) F245.44
(248) X67.93 Y87.22 Z4.90 W338.77 T-17.79 (327)
(249) F291.73
(250) X66.81 Y90.79 Z4.12 W355.65 T-17.79 (328)
(251) F314.00
(252) X65.70 Y94.36 Z3.83 W17.45 T-17.79 (329)
(253) F291.39
(254) X64.58 Y97.93 Z4.13 W39.23 T-17.79 (330)
(255) F245.03
(256) X63.47 Y101.50 Z4.91 W56.06 T-17.79 (331)
(257) F200.91
(258) X62.35 Y105.07 Z5.99 W67.57 T-17.79 (332)
(259) F166.35
(260) X61.23 Y108.64 Z7.23 W75.36 T-17.79 (333)
(261) F140.33
(262) X60.12 Y112.1 Z8.57 W80.80 T-17.79 (334)
(263) F120.75
(264) X59.00 Y115.78 Z9.96 W84.74 T-17.79 (335)
(265) F105.60
(266) X57.89 Y119.35 Z11.39 W87.7 T-17.79 (336)
(267) F93.65
(268) X56.77 Y122.92 Z12.84 W90.00 T-17.79 (337)
(269) F105.60
(270) X55.66 Y119.35 Z11.39 W92.30 T-17.79 (338)
(271) F120.75
(272) X54.54 Y115.78 Z9.96 W95.26 T-17.79 (339)
(273) F140.38
(274) X53.43 Y112.21 Z8.57 399.20 T-17.79 (340)
(275) F166.35
(276) X52.31 Y108.64 Z7.23 W104.64 6-17.79 (341)
(277) F200.91
(278) X51.19 Y105.07 Z5.99 W112.43 T-17.79 (342)
(279) F245.04
(280) X50.08 Y1010.50 Z4.91 W123.94 T-17.79 (343)
(281) F291.39
(282) X48.96 Y97.93 Z4.13 W140.77 T-17.79 (344)
(283) F314.00
(284) X47.85 Y94.36 Z3.83 W162.55 T-17.79 (345)
(285) F291.73
(286) X46.73 Y90.79 Z4.122 W184.35 T-17.79 (346)
(287) F245.44
(288) X45.62 Y82.22 Z4.90 W201.23 T-17.79 (347)
(289) F201.25
(290) X44.50 Y83.65 Z5.98 W212.79 T-17.79 (348)
(291) F166.61
(292) X43.39 Y89.08 Z7.22 W220.60 T-17.69 (349)
(293) M1=0
(294) RAPID
(295) F152.71
(296) X61.10 Y88.70 Z5.81 W287.35 T-28.17 (350)
(297) LINEAR M1=1
(298) F159.13
(299) X58.21 Y88.70 Z5.57 W275.95 T-28.17 (351)
(300) F159.13
(301) X55.33 Y88.70 Z5.57 W264.05 T-28.17 (352)
(302) F152.71
(303) X52.43 Y88.65 Z5.74 W252.65 T-28.47 (353)
(304) M1=0

Lines (241) through (292) represent a sequence of instructions. As previously stated, line (243) has the largest x-value and line (268) has the largest y-value. In view of the fact that the y-value would be outside of the surface marking frame 40, all y-value would be offset by an appropriate offset value. As before, the number is parentheses corresponds to the finishing line or position in FIG. 13. Note that the final segment of the arrow is drawn with the y-value fixed, and small movements along the x-axis (from right to left) and a small rotation of the w-axis.

The marking of a new pattern has now been fully described. Attention presently turns to making a new pattern over an old pattern. This procedure basically requires alignment of the old pattern with the new pattern to be written. Alignment may be achieved by simply moving the transport vehicle 22 to an appropriate position. A more accurate alignment procedure is described in relation to FIGS. 15, 16, and 17.

Figure 15:
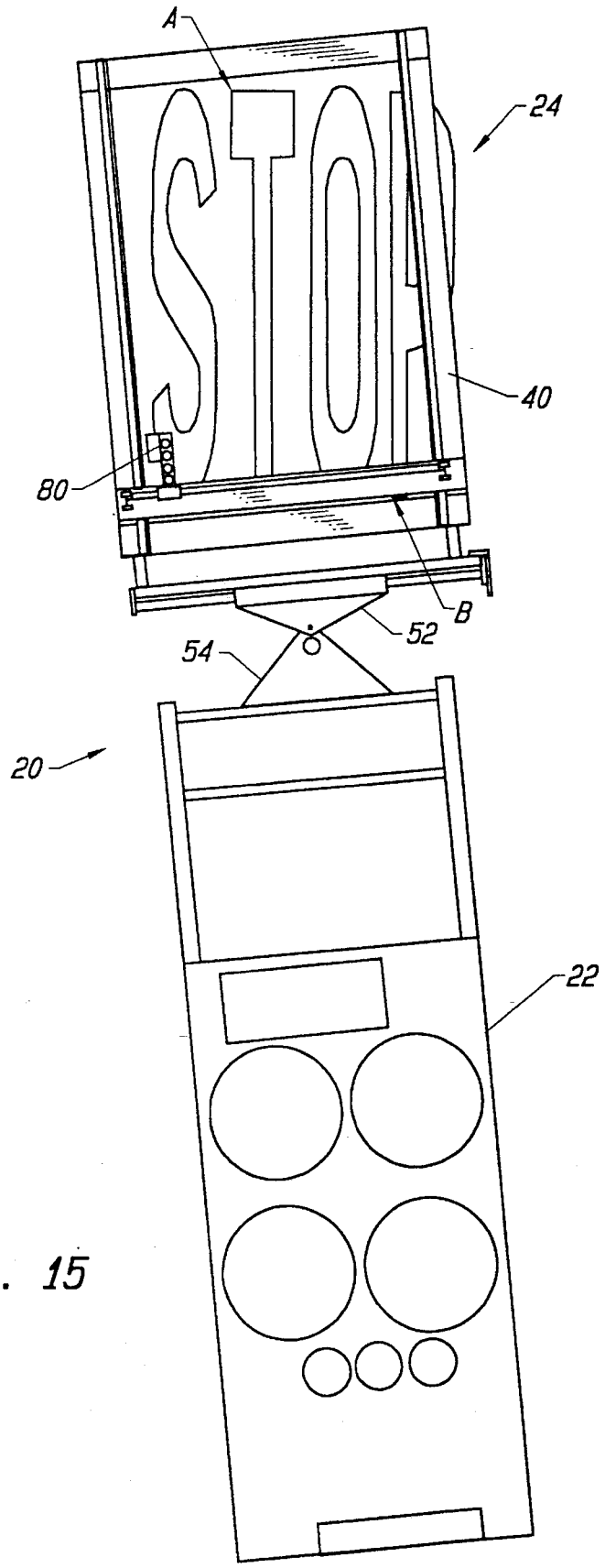
FIG. 15 illustrates the problem of pattern alignment solved in accordance with the invention.
Figure 16:
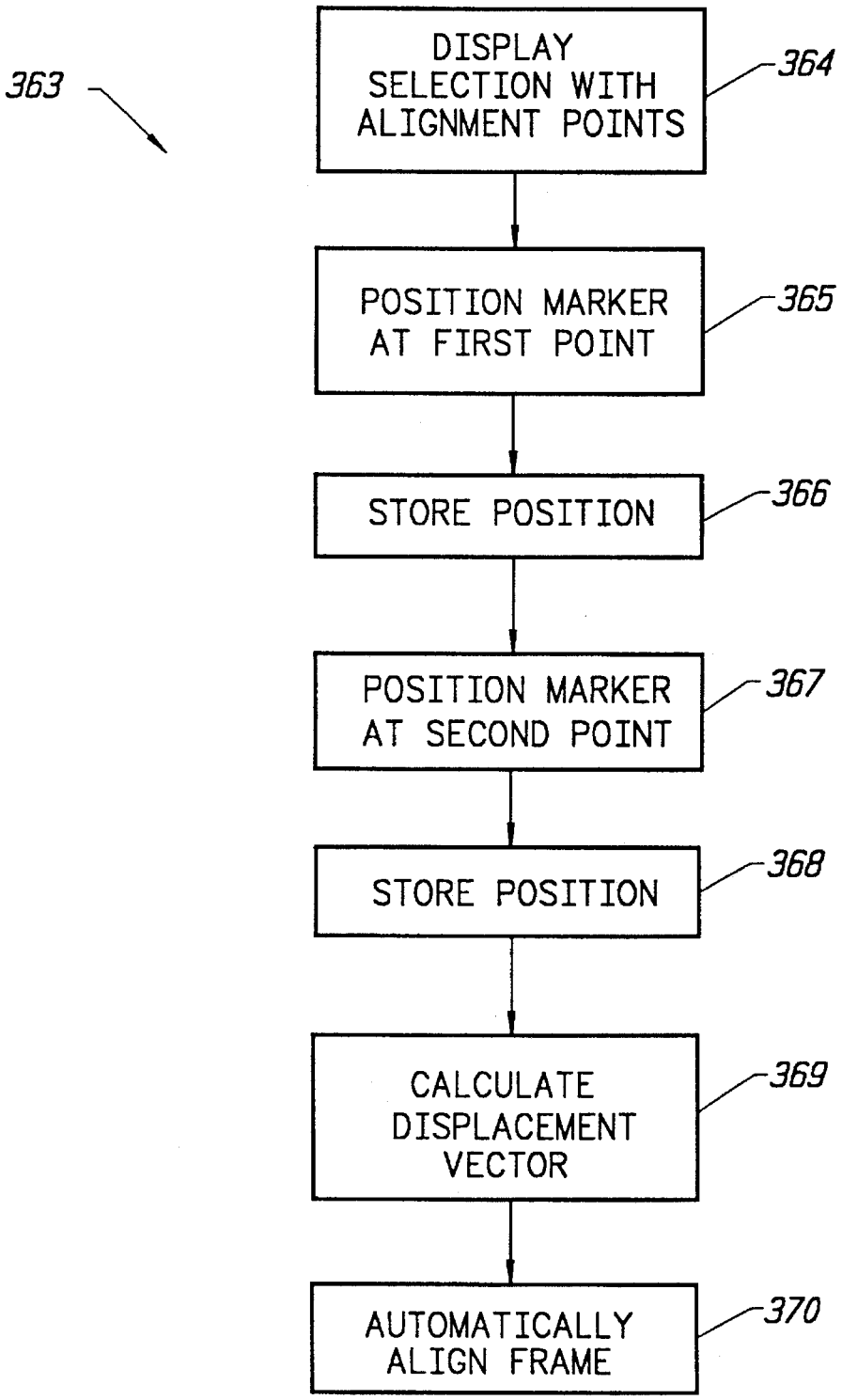
FIG. 16 depicts the control strategy associated with the alignment routine of the invention.

FIG. 15 depicts the transportable surface marking arrangement 20 of the invention wherein the surface marking frame 40 is in mis-alignment with the pattern "stop" that is to be overwritten. FIG. 16 shows the processing steps associated with the alignment procedure 363 of the invention. The first step of the procedure is to display the selected pattern with its corresponding alignment points (block 364). Returning briefly to FIG. 10, the selection "stop" is displayed on monitor 140. In addition to the letters s-t-o-p, a first alignment point "A" and a second alignment point "B" are displayed.

Naturally, the alignment points should be within the interior perimeter of the marking frame 40. In addition, the alignment points should be readily distinguished on the pattern. Thus, the corner of a letter is a good alignment point, while a position on a curve is a poor alignment point.

The next step associated with the procedure is to position a marker at the first alignment point (block 365). The marker may be one of the dispensing heads 96 of the dispenser 80, or a separate marking device on the dispenser 80. The marker is positioned through manual controls associated with the dispenser 80. Typically, the manual controls will be input keys 142 in the form of directional arrows.

After the marker is positioned at the first point, the location of the point within the frame 40 is stored (block 366). Recall that all movement devices have corresponding encoding devices that track the position of the dispenser 80. Therefore, this data can be accumulated, in a manner known in the art, to accurately define the position of the dispenser 80. The marker is subsequently positioned at the second alignment point (block 367) and the position is stored (block 368).

Now that the positions of the alignment points on the surface are known, a displacement vector may be calculated. The displacement vector corresponds to the offset vector required to place the surface marking frame 40 in a proper position to mark a surface. Calculation of a displacement vector may be readily accomplished by relying upon trigonometric relationships. By way of example, a calculation of a displacement vector is described in relation to FIGS. 17A and 17B.

Figure 17A:
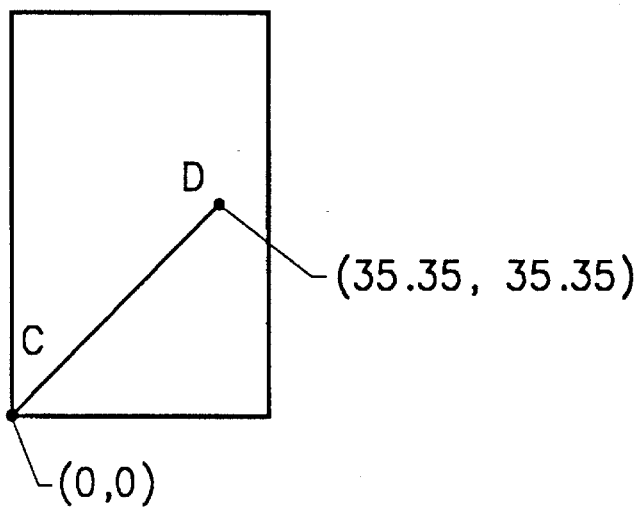
FIG. 17 illustrates the process of calculating a displacement vector in accordance with the alignment routine.
Figure 17B:
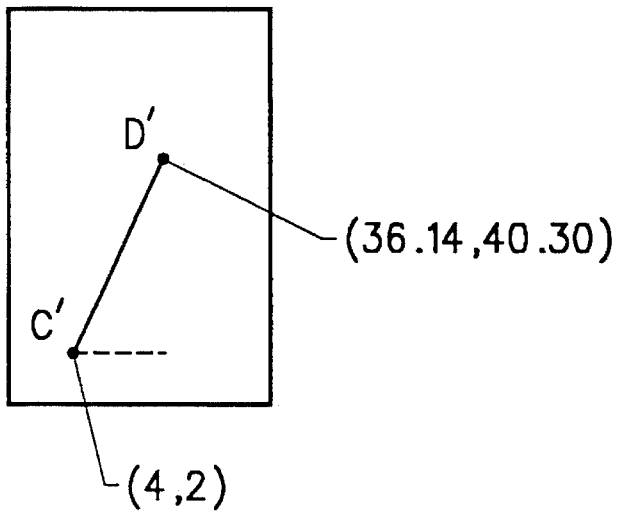

FIG. 17A shows a first ideal alignment point "C" and a second ideal alignment point "D". In this example, "C" is at position (0,0), while "D" is at position (35.35,35.35), thereby forming a line 50 inches long at a 45° angle. The stored alignment values, obtained from FIG. 17B, are (4,2) for position "C'" and (36.14,40.30) for position "D'". The linear offset to center the position "C'" at the position (0,0) is x=4 and y=2. The angle offset to align the line of FIG. 17B with the line of FIG. 17A may be calculated through the trigonometric relationship: $\tan^{-1}\{(Y_2-Y_1)/(X_2-X_1)\}=\tan^{-1}\{(40.30-2)/(36.14-4)\}=50°$. Since the actual angle of the measured line is 50°and the desired angle is 45°, the angle offset to align the line of FIG. 17B with the line of FIG. 17A is −5°.

Returning now to FIG. 16, the final step associated with the alignment procedure of the invention is to align the surface marking frame 40 (block 370). Relying upon the foregoing example, the frame 40 would be moved 4 inches along the x'-axis and 2 inches along the y'-axis. The x'-axis movement would be accomplished through the lateral drive hydraulic cylinder 56 and the y'-axis movement would be accomplished through the first and second horizontal piston hydraulic cylinders 60, 62. The frame would be rotated −5° by using the frame rotation drive motor 58.

A complete working embodiment of the invention has been disclosed, including sequences of commands that may be used to apply typical patterns to a surface. A number of techniques may be used to define an appropriate sequence of commands to execute a given pattern. The following discussion sets forth merely one approach to defining appropriate commands.

Figure 18:
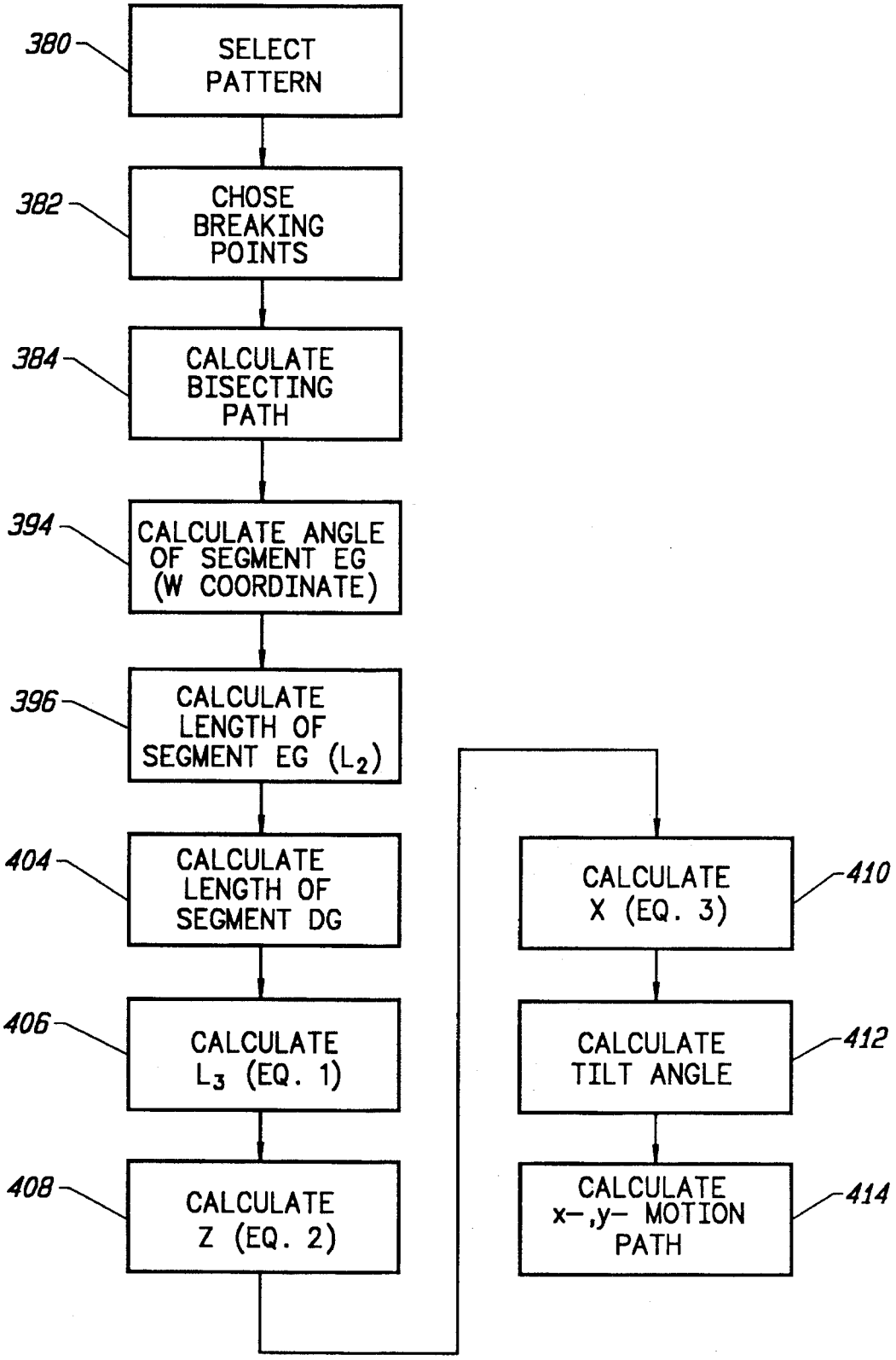
FIG. 18 illustrates an automated control strategy for generating machine control commands to be executed in accordance with the invention.

FIG. 18 describes an instruction generation procedure 372 that may be followed in developing machine control commands to execute a selected pattern. The first step associated with the operation is to select a pattern (block 380). The selected pattern may be taken from a Computer Aided Design library or it may be a pattern developed by the user. After a pattern is selected, break points (destination segment lines) in the pattern are chosen (block 382). FIG. 11 shows the letter "S" with a number of logical destination segment lines form groups of block boundaries.

Figure 19:
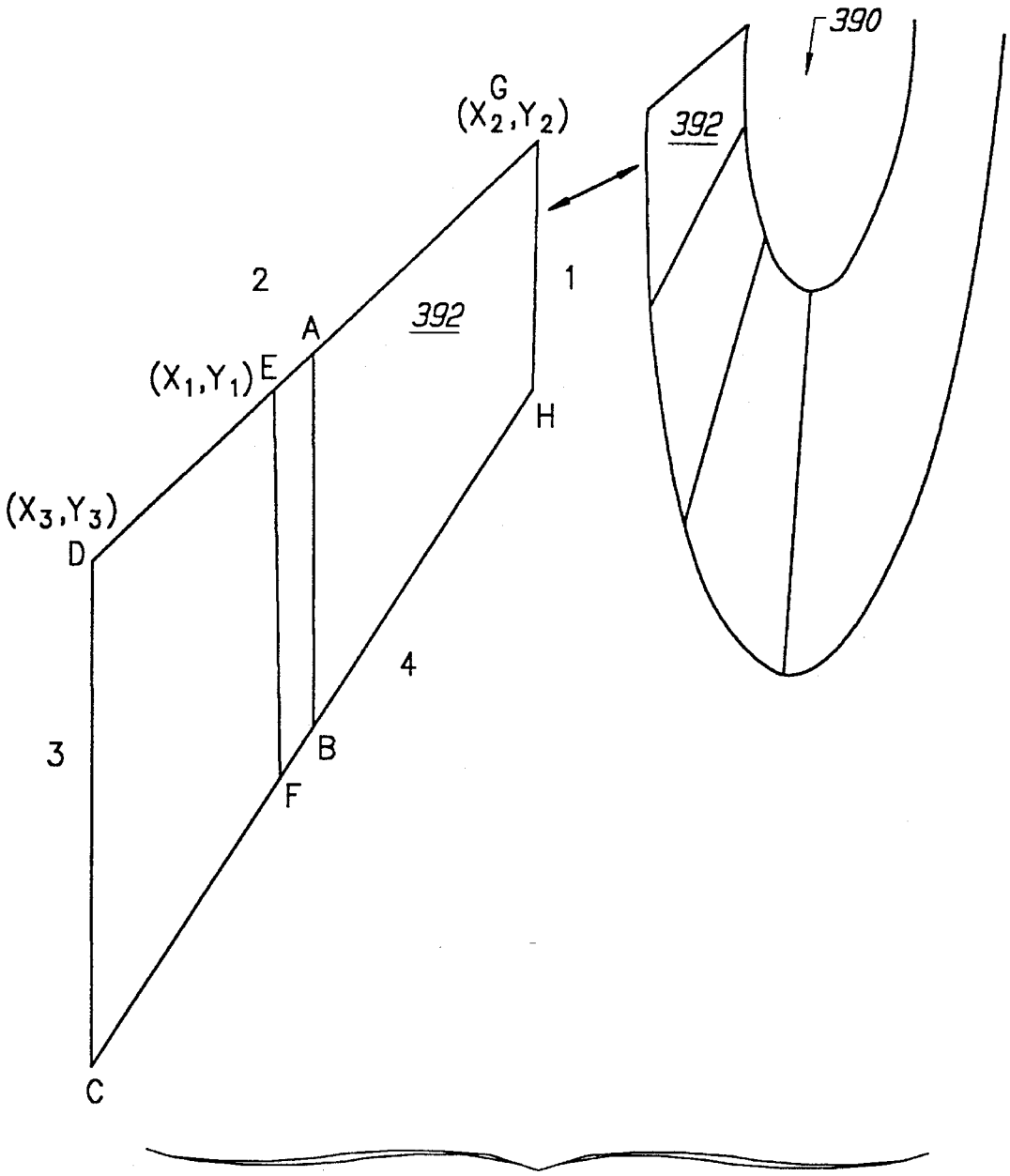
FIG. 19 graphically demonstrates physical relationships between a pattern, a dispenser, and the surface to be marked.

The next step associated with the operation of FIG. 11 is to calculate a bisecting path through the pattern (block 384). A bisecting path is defined for each segment set of by break points. For a rectilinear pattern such as the letters T,I,F,H,L, the division is simple because the shapes are symmetrical. The center lines of the shapes are the bisecting path. For other patterns, the bisecting path may be derived through an iterative method of area calculation. This operation is exhibited in relation to FIG. 19. The destination segment line 390 in FIG. 19 is the bottom portion of the letter "S". The letter includes a number of break points defining blocks. Each block is approximately a polygon. The block 392 within the segment 390 is enlarged on the left side of the figure.

The iterative area calculation to define the bisecting path commences by calculating the area enclosed by edges 1, 2, 3, and 4, to yield a first area sum. The first area sum is divided in half to render a half-area estimation. Then, the area enclosed by points A, B, C, and D is calculated, where A and B are approximate midpoints for edges 2 and 1, respectively. This calculation yields a second area sum that is compared to the half-area estimation to produce an excess area value. The length of the line segment AB is then measured to yield a polygon length. The polygon length is divided into the excess area value to obtain the offset required to define the bisecting path. Using the foregoing procedure, the bisecting path is calculated for each block in the pattern.

The next step associated with the instruction generation process of the invention is to calculate the angle of line EG (block 394), shown in FIG. 19. This angle may be calculated by using the following function: $\mathrm{ArcTan}[(Y_2-Y_1)/(X_2-X_1)]$. The resultant value may be used as a rotation value (W).

Figure 20:
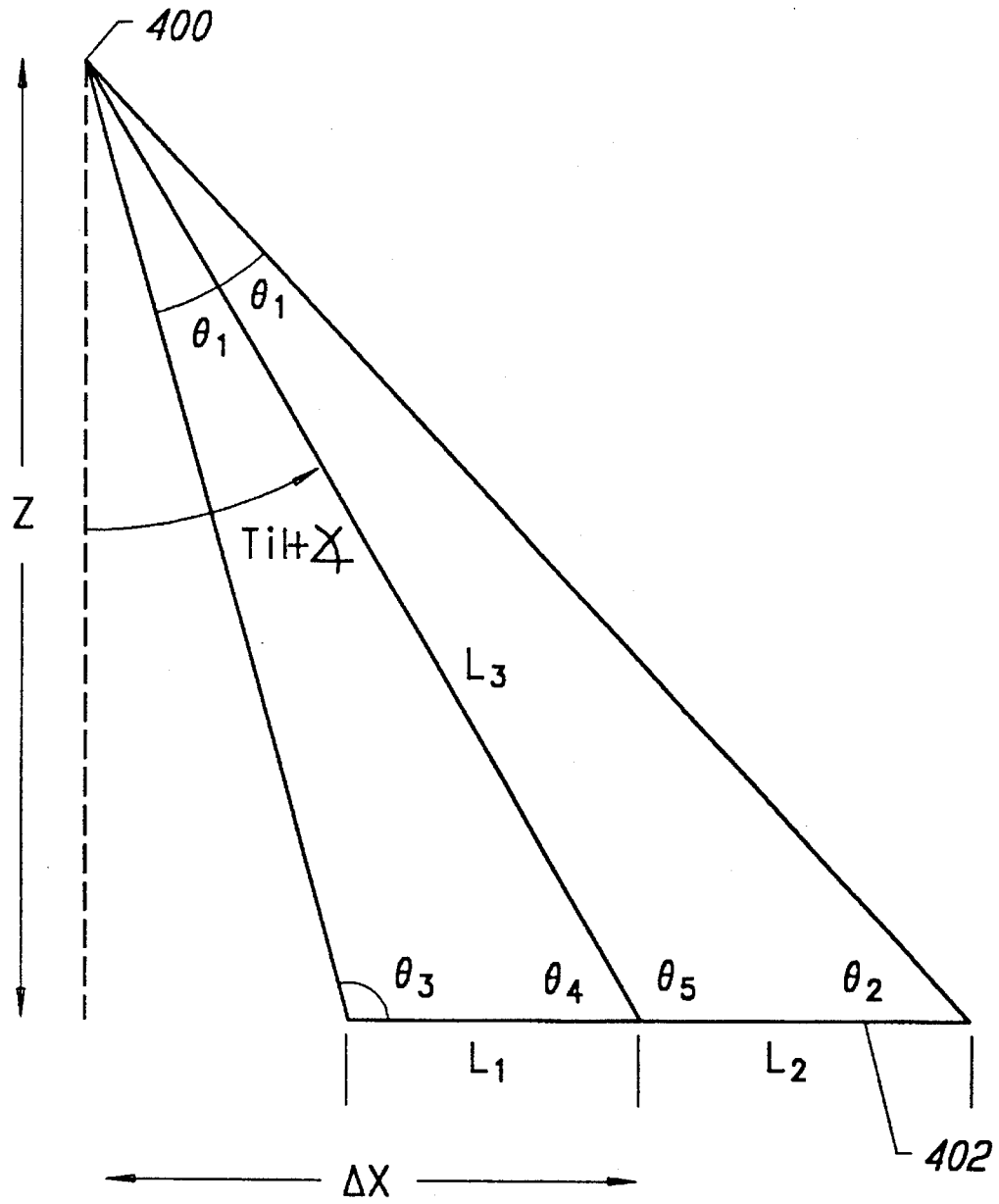
FIG. 20 illustrates a mathematical model that may be used to generate machine control instructions.

The next step is to calculate the length of the line segment EG (block 396). The length may be calculated by relying upon the following function: $\mathrm{SQRT}[(Y_2-Y_1)^2+(X_2-X_1)^2]$. The resultant value is identified as L1. This is coordinated with a mathematical model of the system of the invention. The mathematical model is shown in FIG. 20. Point 400 represents the location of a dispensing head (not shown). Line 402 represents the surface to be marked. The cumulative sum of line segment L1 and L2 represents the spray pattern from the dispensing head. The line segment DE in FIG. 19 is equivalent to L1 and the line segment EG in FIG. 19 is equivalent to L2. Trigonometric relationships may be used to define the following equations:

Equation 1:

$$L_3=\sqrt{\frac{1}{\left[\left(\frac{L_1-L_2\cos 2\theta_1}{2L_1L_2\cos\theta_1}\right)^2+\left(\sin\frac{\theta_1}{L_1}\right)^2\right]}}$$

Equation 2:

$$Z=L_3\sin[\sin^{-1}(L_3/L_1\sin\theta_1)+\theta_1]$$

Equation 3:

$$\Delta X=L_3\cos[180-\theta_1-\sin^{-1}(L_3/L_1\sin\theta_1)]$$

Returning now to FIG. 18, the next step is to calculate the length of segment DG ($\mathrm{SQRT}[(Y_3-Y_2)^2+(X_3-X_2)^2]$). The length of segment DG is equivalent to the length of L1 and L2 in FIG. 20. Since L2 is known, L1 may now be calculated.

Assuming now that the spray width angle is 80°, then $\theta_1$ is equivalent to 40° (FIG. 20 is not to scale). With $\theta_1$ known, the length of line segment L3 may be calculated using equation 1 (block 406).

The elevational height of the dispensing head (Z) may be calculated using equation 2 (block 408). The value delta-x may be calculated using equation 3 (block 410). The tilt angle is defined as ArcTan(delta-X/Z) (block 412).

All values in a line of instructions have now been defined. Specifically, the elevational (Z) value was defined at block 408 (relying upon Equation 2), the rotation (W) value was defined at block (394), and the tilt angle (T) was defined at block 412. The X and Y values ($X_1$, $Y_1$ in FIG. 19) were derived from the bisecting path (block 384). The actual X and Y values used in a line of instruction are preferably modified to account for the rotation angle (block 414). This may be accomplished as follows: $X=X_1-X_1\cos W$; $Y=Y_1-Y_1\cos W$.

Each line of instruction may be derived using the foregoing methodology. It should be borne in mind that the circle commands (CIRCLE1, CIRCLE2) require additional parameters I and J. As previously indicated, I and J represent arc mid-points between the X and Y starting and finishing coordinates.

One final parameter is speed. The velocity of the dispensing head is calculated in the X-Y plane so that the material is deposited in a constant manner. For example, in pavement marking, a typical optimum thickness of paint is currently 0.020 inches. In one embodiment of the invention, it was determined that a particular configuration (material delivery system, dispensing head size, condition of dispensing head, etc.) produced an application thickness of 0.020 inches at 600 inches per minute and spraying a 4 inch wide pattern. These values may then be used to calculate all other speeds.

For example, if a 9 inch line is desired, the appropriate speed may be calculated as 4 inches/9 inches * 600 inches per minute.

The instruction generation procedure 372 may produce instructions in real-time by relying upon a set of computer code to implement the described steps. Alternately, the instructions may be stored as a set of values in memory module 134.

It should be appreciated that any set of derived values can be modified for a given application. For example, a thru-arrow on a highway should be larger than a thru-arrow on a residential street. Accordingly, each execution instruction associated with a residential street thru-arrow may be multiplied by an appropriate correction factor to result in a set of execution instructions for the larger highway thru-arrow, which constitutes a size-modified pattern. The correction factor may be used to modify the width alone, the height alone, or both the width and height of the pattern.

Figure 21:
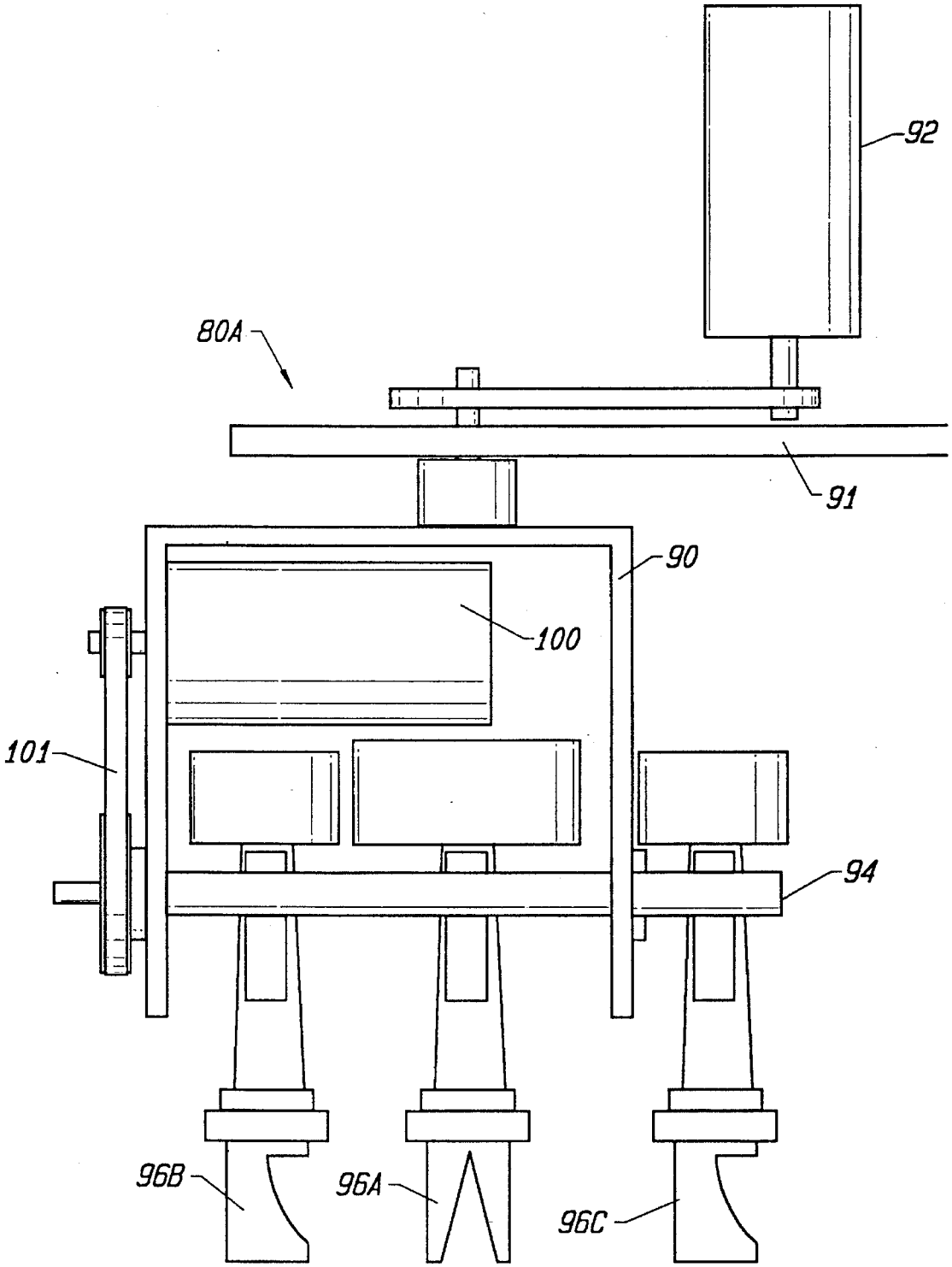
FIG. 21 is a side view of a preferable dispenser with three dispensing heads.

FIG. 21 illustrates a preferred dispenser 80A. The dispenser 80A includes three dispensing heads 96A, 96B, 96C. The middle dispensing head 96A is used for a liquid material, such as paint, while the other two dispensing heads 96B, 96C are used for a solid flowable material, such as glass beads. The solid flowable material dispensing heads 96B, 96C are used to insure that a solid flowable material is always deposited after a liquid material, regardless of the orientation of the dispenser 80A.

It will be appreciated by those skilled in the art that the surface marking mechanism 24 of the invention is not limited to an X-Y-Z linear motion frame, and may be implemented in the form of a robotic arm or arms with a dispenser mounted on the arm, and a different set of geometrical motions to execute the control programs for surface marking.

The foregoing descriptions of specific embodiments of the present invention are presented for purposes of illustration and description. They are not intended to be exhaustive or to limit the invention to the precise forms disclosed, obviously many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated. It is intended that the scope of the invention be defined by the following claims and their equivalents.

We claim:

1. In an apparatus for marking a surface, the combination comprising:

a surface marking mechanism including:

a location marker supported on said surface marking mechanism;

means for locating said location marker at a first point;

means for identifying the coordinate position of said first point;

means for locating said location marker at a second point;

means for identifying the coordinate position of said second point;

means for comparing said coordinate position of said first point and said coordinate position of said second point with a first ideal coordinate position and a second ideal coordinate position to yield a displacement vector instruction; and means for moving said surface marking mechanism in response to said displacement vector instruction.

2. The apparatus of claim 1 wherein said surface marking mechanism is a material dispenser.

3. The apparatus of claim 2 wherein said surface marking mechanism further comprises means for manipulating said material dispenser relative to a plane substantially parallel to said surface, means for moving said material dispenser along a z-axis generally orthogonal to said surface, and means for rotating said material dispenser around a w-axis substantially normal to said surface; and a controller which generates control signals that are conveyed to said surface marking mechanism such that said surface marking mechanism generates a predetermined pattern on said surface.

4. The apparatus of claim 3 wherein said surface marking mechanism further comprises means for tilting said material dispenser such that said material dispenser forms an angle with said W-axis.

5. The apparatus of claim 4 wherein said tilting means tilts said material dispenser, responsive to said control signals, to dispense a material on said surface such that said material is applied with a predetermined distribution between an extended perimeter region and a contracted perimeter region.

6. The apparatus of claim 5 wherein said tilting means tilts said material dispenser to form a surface proximate material dispenser position and a surface distal material dispenser position, said surface proximate material dispenser position applying a first amount of material to said extended perimeter region and said surface distal material dispenser region applying a second amount of material, less-than said first amount of material, to said contracted perimeter region.

7. The apparatus of claim 3 further comprising means for positioning said surface marking mechanism in a different location in said plane.

8. The apparatus of claim 7 wherein said positioning means is manipulated to reposition said surface marking mechanism from a first position covering a first segment of a pattern to a second position covering a second segment of said pattern.

9. The apparatus of claim 8 wherein said controller processes said control signals to produce reposition control signals to move said surface marking mechanism from said first position to said second position.

10. The apparatus of claim 3 further comprising means for pivoting said surface marking mechanism around a w'-axis.

11. The apparatus of claim 3 further comprising means for securing said surface marking mechanism to a transport vehicle.

12. The apparatus of claim 3 wherein said dispenser includes a first dispensing head for dispensing a liquid flowable material and a second dispensing head for dispensing a solid flowable material.

13. The apparatus of claim 12 wherein said dispenser further comprises a third dispensing head for dispensing a solid flowable material.

14. The apparatus of claim 12 wherein said first dispensing head has a fan width angle of between 0° and 180°.

15. The apparatus of claim 12 wherein said first dispensing head has a fan width angle of approximately 80°.

16. The apparatus of claim 12 wherein said surface marking mechanism includes means for generating an initial velocity for said material dispenser before said liquid flowable material and said solid flowable material are deposited.

17. The apparatus of claim 3 wherein said controller includes a memory device for storing a pattern library having a plurality of patterns, each of said patterns having a corresponding set of execution instructions that generate said control signals.

18. The apparatus of claim 17 wherein said controller includes means for modifying said execution instructions to form a size-modified pattern corresponding to said predetermined pattern.

19. The apparatus of claim 3 wherein said moving means modulates said dispenser along said z-axis to dispense a material on said surface with a desired width.

20. The apparatus of claim 3 wherein said rotating means rotates said material dispenser, responsive to said control signals, to dispense a material on said surface with a desired curvature between an inner perimeter line and an outer perimeter line.

* * * * *